US005294531A

United States Patent [19]

Kobayashi et al.

[11] Patent Number: 5,294,531

[45] Date of Patent: Mar. 15, 1994

[54] YELLOW DYE-FORMING COUPLER AND SILVER HALIDE COLOR PHOTOGRAPHIC LIGHT-SENSITIVE MATERIAL CONTAINING THE SAME

[75] Inventors: Hidetoshi Kobayashi; Yasuhiro Yoshioka; Yoshio Shimura, all of Ashigara, Japan

[73] Assignee: Fuji Photo Film Co., Ltd., Kanagawa, Japan

[21] Appl. No.: 945,609

[22] Filed: Sep. 16, 1992

[30] Foreign Application Priority Data

Sep. 18, 1991 [JP] Japan ..... 3-265538

[51] Int. Cl.[5] ..... G03C 7/36

[52] U.S. Cl. ..... 430/556; 430/557

[58] Field of Search ..... 430/556, 557

[56] References Cited

U.S. PATENT DOCUMENTS

| | | | |
|---|---|---|---|
| Re 27,848 | 12/1973 | Weissberger et al. . | |
| 4,336,327 | 6/1982 | Tanaka et al. | 430/556 |
| 4,992,360 | 2/1991 | Tsuruta et al. | 430/556 |

*Primary Examiner*—Lee C. Wright

*Attorney, Agent, or Firm*—Birch, Stewart, Kolasch & Birch

[57] ABSTRACT

A bicyclo[m.n.0]alkane-1-ylcarbonylacetamide-based yellow dye-forming coupler wherein m represents an integer of 2 to 5, n represents an integer of 1 to 3, the sum of m and n is an integer of 3 to 7, and 0 represents zero.

19 Claims, No Drawings

YELLOW DYE-FORMING COUPLER AND SILVER HALIDE COLOR PHOTOGRAPHIC LIGHT-SENSITIVE MATERIAL CONTAINING THE SAME

BACKGROUND OF THE INVENTION

1. Field of the Invention

The present invention relates to a novel acylacetamide-based yellow dye-forming coupler and a silver halide color photographic light-sensitive material containing this yellow dye-forming coupler.

2. Description of the Related Art

When a silver halide color photographic light-sensitive material is exposed and developed, an oxidized aromatic primary amine developing agent reacts with a dye-forming coupler (to be referred to as a coupler hereinafter), thereby forming a dye image.

In this method, a color reproduction technique using subtractive color processes is generally used. In order to reproduce blue, green, and red, dye images of yellow, magenta, and cyan, which are complementary colors of blue, green, and red, respectively, are formed. An acylacetamide coupler and a malondianilide coupler are used as yellow dye-forming couplers (to be referred to as yellow couplers hereinafter) to form a yellow dye image. A 5-pyrazolone coupler, a pyrazolotriazole coupler, and the like are generally used as magenta couplers to form a magenta dye image. A phenol coupler and a naphthol coupler are generally used as cyan couplers to form a cyan dye image.

Yellow, magenta, cyan dyes obtained from these couplers are generally used in silver halide emulsion layers which have sensitivities to radiations having a relationship of complementary colors with radiations absorbed by these dyes and their adjacent layers.

As the yellow coupler, especially image formation couplers, an acylacetamide coupler represented by a benzoylacetanilide coupler or a pivaloylacetanilide coupler is generally used. The former coupler has a high coupling activity with an aromatic primary amine developing agent and can produce a yellow dye having a large molecular absorption coefficient. Therefore, this coupler is mainly used in a photographic color light-sensitive material for photographing which needs high sensitivity and, particularly, a color negative film. The latter coupler is excellent in spectral absorption characteristics and dye fastness and is therefore mainly used in color paper and a color reversal film.

The benzoylacetanilide-based coupler has a high coupling reactivity with the oxidized form of an aromatic primary amine developing agent during development and can produce a yellow azomethine dye having a large molecular absorption coefficient. However, the benzoylacetanilide-based coupler is poor in spectral absorption characteristics of a yellow image. The pivaloylacetanilide-based coupler is excellent in spectral absorption characteristics and fastness of the yellow image. However, this coupler is poor in coupling reactivity with the oxidized form of an aromatic primary amine developing agent during development. In addition, the resultant yellow azomethine dye of the coupler has a problem of a small molecular absorption coefficient.

The high coupling reactivity of a coupler and the large molecular absorption coefficient of the resultant dye allow a high sensitivity, a large gamma value, and a high color density to so-called improved color forming properties. The excellent spectral absorption characteristics in the yellow image indicate, for example, good sharpness in the long-wavelength limit in spectral absorption, and less unnecessary absorption in green region.

A strong demand, therefore, has arisen for a yellow coupler having both the advantages, i.e., improved color forming properties (i.e., a high coupling reactivity of the coupler and a large molecular absorption coefficient of the resultant dye), and excellent spectral absorption characteristics and fastness of the resultant color image.

Examples of the acyl group of the acylacetanilide-based coupler are pivaloyl, 7,7-dimethylnorbornane-1-carbonyl, and 1-methylcyclohexane-1-carbonyl disclosed in U.S. Pat. No. Re. 27,848, cyclopropane-1-carbonyl and cyclohexane-1-carbonyl disclosed in JP-A-47-26133 ("JP-A" means Published Unexamined Japanese Patent Application), and adamantane-1-carbonyl disclosed in JP-A-56-87041. Each of these couplers, however, is unsatisfactory in any of coupling reactivity, a molecular absorption coefficient, or spectral absorption characteristics or fastness of the resultant dye image.

Recent photographic light-sensitive materials are required to have a higher sensitivity, a better image quality, and a higher toughness more eagerly than before. Accordingly, a strong demand has arisen for a coupler superior in color forming properties, and spectral absorption characteristics and fastness of the resultant dye image. However, it is difficult for the conventional yellow couplers including those described in the above three prior-art inventions to satisfy all these requirements at the same time.

SUMMARY OF THE INVENTION

It is, therefore, the first object of the present invention to provide a yellow coupler having improved color forming properties, and a silver halide color photographic light-sensitive material containing this yellow coupler.

It is the second object of the present invention to provide a yellow coupler capable of producing a yellow dye image having excellent spectral absorption characteristics upon color development, and a silver halide color photographic light-sensitive material containing this yellow coupler.

It is the third object of the present invention to provide a yellow coupler capable of producing a yellow dye image upon color development, which is superior in fastness against heat, light, and moisture, and a silver halide color photographic light-sensitive material containing this yellow coupler.

In order to achieve the above objects of the present invention, there are provided a yellow coupler (1) and a silver halide color photographic light-sensitive material (2) as follows:

(1) a bicyclo[m.n.0]alkane-1-ylcarbonylacetamide-based yellow dye-forming coupler (wherein m represents an integer of 2 to 5, n represents an integer of 1 to 3, the sum of m and n is an integer of 3 to 7, and 0 represents zero); and (2) a silver halide color photographic light-sensitive material containing at least one type of yellow dye-forming couplers described in item (1) above.

DETAILED DESCRIPTION OF THE INVENTION

A yellow coupler according to the present invention will be described in detail below.

The yellow coupler according to the present invention is preferably represented by Formula (1) below:

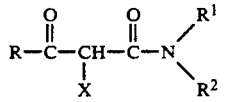

Formula (1)

In Formula (1), R represents a bicyclo[m.n.0]alkane-1-yl group. m represents an integer of 2 to 5, n represents an integer of 1 to 3, and the sum of m and n is an integer of 3 to 7. 0 represents zero. The alkane is pentane, hexane, heptane, octane, and nonane when the sum of m and n is 3, 4, 5, 6, and 7, respectively. The bicyclo[m.n.0]alkane-1-yl group may have substituents.

In Formula (1), each of $R^1$ and $R^2$ independently represents a hydrogen atom, an alkyl group, an aryl group, or a heterocyclic group.

In Formula (1), X represents a hydrogen atom or a group (to be referred to as a split-off group hereinafter) which can split off upon a coupling reaction with the oxidized form of an aromatic primary amine developing agent.

The yellow coupler according to the present invention is more preferably represented by Formula (2) below:

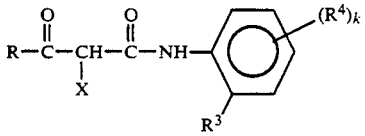

Formula (2)

In Formula (2), R and X are the same as those of Formula (1).

In Formula (2), $R^3$ represents a hydrogen atom, a halogen atom (F, Cl, Br, or I; this applies in the following description of Formula (2)), an alkoxy group, an aryloxy group, an alkyl group, or an amino group (including mono- and di-substituted amino groups), $R^4$ represents a group substitutable on a benzene ring, and k represents an integer of 0 to 4.

Examples of $R^4$ are halogen, alkyl, aryl, alkoxy, aryloxy, alkoxycarbonyl, aryloxycarbonyl, carbonamido, sulfonamido, carbamoyl, sulfamoyl, alkylsulfonyl, ureido, sulfamoylamino, alkoxycarbonylamino, alkoxysulfonyl, acyloxy, nitro, heterocyclic, cyano, acyl, amino, imido, alkylsulfonyloxy, arylsulfonyloxy, carboxyl, sulfo, and hydroxyl (to be referred to as a substituent group A). Examples of the split-off group X are a heterocyclic group which combines with a coupling active position by a nitrogen atom, aryloxy, arylthio, acyloxy, alkylsulfonyloxy, arylsulfonyloxy, heterocyclicoxy, and halogen atom.

When a substituent in the formulas from Formula (1) is an alkyl group or contains an alkyl group, this alkyl group means, unless otherwise defined, a straight-chain, branched, or cyclic alkyl group which may be substituted or may contain an unsaturated bond.

In the formulas from Formula (1), if the substituent is an aryl group or contains an aryl group, this aryl group means a monocyclic or condensed-ring aryl group, unless otherwise defined.

In the formulas from Formula (1), if the substituent is a heterocyclic group or contains a heterocyclic group, this heterocyclic group means, unless otherwise defined, a 3- to 8-membered monocyclic or condensed-ring heterocyclic group which contains at least one hereto atom selected from O, N, S, P, Se, and Te in its ring and may be substituted.

The substituents preferably used in Formula (2) will be described below.

Specific examples of the bicyclo[m.n.0]alkane-1-yl group represented by R- in Formula (2) are
bicyclo[2.1.0]pentane-1-yl,
bicyclo[2.2.0]hexane-1-yl,
bicyclo[3.1.0]hexane-1-yl,
bicyclo[3.2.0]heptane-1-yl,
bicyclo[3.3.0]octane-1-yl,
bicyclo[4.1.0]heptane-1-yl,
bicyclo[4.2.0]octane-1-yl,
bicyclo[4.3.0]nonane-1-yl,
bicyclo[5.1.0]octane-1-yl, and
bicyclo[5.2.0]nonane-1-yl.

R- in Formula (2) is preferably a group in which the sum of m and n is 3 to 5, and more preferably a group represented by the following Formula (3), (4), (5), (6), or (7).

Formula (3)

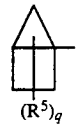

Formula (4)

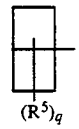

Formula (5)

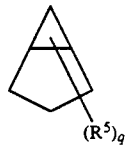

Formula (6)

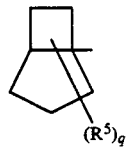

Formula (7)

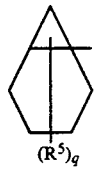

In formulas (3) to (7), $R^5$ represents a group substitutable to bicycloalkane, and q represents an integer of 0 to 5. If q represents the plural number, a plurality of $R^5$'s may be the same or different.

$R^5$ preferably represents a group selected from halogen, cyano, alkyl, aryl, alkoxy, aryloxy, alkylthio, arylthio, alkylsulfonyl, arylsulfonyl, acyl, alkoxycarbonyl, aryloxycarbonyl, carbonamido, sulfonamido, imido, heterocyclic, carbamoyl, sulfamoyl, alkoxycarbonylamino, sulfamoylamino, phosphono, ureido, carboxyl, sulfo, and hydroxyl, and more preferably represents halogen, cyano, alkyl, aryl, or acyl.

The substitution position of $R^5$ in each of groups represented by Formulas (3) to (7) is preferably a position except for an α-position of the carbonyl group to be bonded.

q is preferably an integer of 0 to 3, and more preferably 0 or 1.

A total number of carbon atoms (to be referred to as a C number hereinafter) of a group represented by Formula (3) is preferably 5 to 36, and more preferably 5 to 16.

The C number of a group represented by Formula (4) is preferably 6 to 36, and more preferably 6 to 16.

The C number of the group represented by Formula (5) is preferably 6 to 36, and more preferably 6 to 16.

The C number of the group represented by Formula (6) is preferably 7 to 36, and more preferably 7 to 16.

The C number of the group represented by Formula (7) is preferably 7 to 36, and more preferably 7 to 16.

In Formula (2), $R^3$ preferably represents halogen, or alkoxy having a C number of 1 to 30, aryloxy having a C number of 6 to 30, alkyl having a C number of 1 to 30, or amino having a C number of 0 to 30, each of which may be substituted. Examples of its substituent are halogen, alkyl, alkoxy, and aryloxy.

In Formula (2), $R^4$ preferably represents halogen, or alkyl having a C number of 1 to 30, aryl having a C number of 6 to 30, alkoxy having a C number of 1 to 30, alkoxycarbonyl having a C number of 2 to 30, aryloxycarbonyl having a C number of 7 to 30, carbonamido having a C number of 1 to 30, sulfonamido having a C number of 1 to 30, carbamoyl having a C number of 1 to 30, sulfamoyl having a C number of 0 to 30, alkylsulfonyl having a C number of 1 to 30, arylsulfonyl having a C number of 6 to 30, ureido having a C number of 1 to 30, sulfamoylamino having a C number of 0 to 30, alkoxycarbonylamino having a C number of 2 to 30, heterocyclic having a C number of 1 to 30, acyl having a C number of 1 to 30, alkylsulfonyloxy having a C number of 1 to 30, or arylsulfonyloxy having a C number of 6 to 30, each of which may be substituted. An example of its substituent is a substituent selected from the substituent group A.

In Formula (2), k preferably represents an integer of 1 or 2, and the substitution position of $R^4$ is preferably a meta or para position with respect to R—CO—CH(X-)—CONH—.

In Formula (2), X represents a heterocyclic which combines with a coupling active position by a nitrogen atom or aryloxy group.

When X represents a heterocyclic group, X is preferably a 5- to 7-membered monocyclic or condensed-ring heterocyclic group which may be substituted. Examples of this heterocyclic ring are succinimide, maleinimide, phthalimide, diglycolimide, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione, imidazolidine-2-one, oxazolidine-2-one, thiazolidine-2-one, benzimidazolidine-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone-2-pyrazone, 2-amino-1,3,4-thiazolidine, and 2-imino-1,3,4-thiazolidine-4-one. These heterocyclic rings may have a substituent group. Examples of substituents of these heterocyclic rings are substituents selected from the substituent group A.

When X represents an aryloxy group, X is preferably aryloxy having a C number of 6 to 30 and may be substituted with a group selected from the substituents enumerated above as substituents when X represents a heterocyclic ring. Preferable examples of substituents for the aryloxy group are halogen, cyano, nitro, carboxyl, trifluoromethyl, alkoxycarbonyl, carbonamido, sulfonamido, carbamoyl, sulfamoyl, alkylsulfonyl, arylsulfonyl, and cyano.

Substituents particularly preferably used in Formula (2) will be described below, but R has already been described above.

$R^3$ particularly preferably represents chlorine, fluorine, alkyl (for example, methyl, trifluoromethyl, ethyl, isopropyl, and t-butyl) having a C number of 1 to 6, alkoxy (for example, methoxy, ethoxy, methoxyethoxy, and butoxy) having a C number of 1 to 24, or aryloxy (for example, phenoxy, p-tolyloxy, and p-methoxyphenoxy) having a C number of 6 to 24, and most preferably chlorine, methoxy, or trifluoromethyl.

$R^4$ particularly preferably represents halogen, alkoxy, alkoxycarbonyl, aryloxycarbonyl, carbonamido, sulfonamido, carbamoyl, or sulfamoyl, and most preferably alkoxy, alkoxycarbonyl, carbonamido, sulfamoyl, or sulfonamido group.

X is particularly preferably a group represented by Formula (8) or (9) below:

Formula (8)

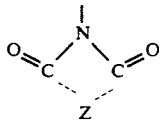

Formula (9)

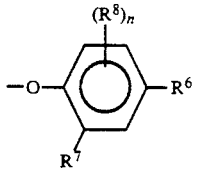

In Formula (8), Z represents —O—$CR^9R^{10}$—, —S—$CR^9R^{10}$—, —$NR^{11}$—$CR^9R^{10}$—, —$NR^{11}$—$NR^{12}$—, —$NR^{11}$—CO—, —$CR^9R^{10}$—$CR^{13}R^{14}$—, or —$CR^{15}$=$CR^{16}$— wherein each of $R^9$, $R^{10}$, $R^{13}$, and $R^{14}$ represents hydrogen, alkyl, aryl, alkoxy group, aryloxy, alkylthio, arylthio, alkylsulfonyl, arylsulfonyl, or amino, each of $R^{11}$ and $R^{12}$ represents hydrogen, alkyl, aryl, alkylsulfonyl, arylsulfonyl, or alkoxycarbonyl, and each of $R^{15}$ and $R^{16}$ represents hydrogen, alkyl, or aryl. $R^{15}$ may combine with $R^{16}$ to form a benzene ring. $R^9$ and $R^{10}$, $R^{10}$ and $R^{11}$, $R^{11}$ and $R^{12}$, or $R^9$ and $R^{13}$ may combine with each other to form a ring (for example, cyclobutane, cyclohexane, cycloheptane, cyclohexene, pyrrolidine, or piperidine).

Of heterocyclic rings represented by Formula (8), most preferable heterocyclic groups are those in which Z represents —O—$CR^9R^{10}$—, —$NR^{11}$—$CR^9R^{10}$—, or —$NR^{11}$—$NR^{12}$— in Formula (8).

The heterocyclic group represented by Formula (8) has a C number of 2 to 30, preferably 4 to 20, and more preferably 5 to 16.

In Formula (9), at least one of $R^6$ and $R^7$ is a member selected from halogen, cyano, nitro, trifluoromethyl, carboxyl, alkoxycarbonyl, carbonamido, sulfonamido, carbamoyl, sulfamoyl, alkylsulfonyl, arylsulfonyl, and acyl, and the other may be hydrogen, an alkyl, or alkoxy. $R^8$ represents the same group as $R^6$ or $R^7$, and n represents an integer of 0 to 2. The aryloxy group represented by Formula (9) has a C number of 6 to 30, preferably 6 to 24, and more preferably 6 to 15.

A coupler represented by Formula (1) may form dimers or polymers of higher orders, which combine together via a divalent group or a group having a higher valance, in the substituent R, $R^1$, $R^2$, or X. In this case, the number of carbon atoms may fall outside the range of carbon atoms represented in each substituent described above.

When a coupler represented by Formula (1) forms a polymer, a typical example of this polymer is a homopolymer or copolymer of an addition polymerization ethylene-based unsaturated compound (yellow color forming monomer) having a yellow dye-forming coupler moiety, and is preferably represented by Formula (10) below:

$$-(C_i)_{g_i}-(H_j)_{h_j}-$$

In Formula (10), $G_i$ is a repeating unit derived from a color forming monomer and is a group represented by Formula (11) below. $H_j$ is a group as a repeating unit derived from a non-color forming monomer. i represents a positive integer, and j represents 0 or a positive integer. $g_i$ and $h_j$ represent wt % of $G_i$ or $H_j$. If i or j represents 2 or more, $G_i$ or $H_j$ represents a plurality of types of repeating units.

In Formula (10), $g_i$ is preferably 10% to 70%, and more preferably 30% to 60%, $h_j$ is preferably 90% to 30%, and more preferably 70% to 40%.

Formula (11)

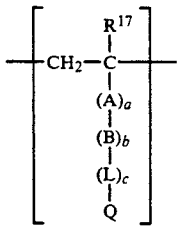

In Formula (11), $R^{17}$ represents hydrogen, alkyl having 1 to 4 carbon atoms, or chlorine, A represents —CONH—, —COO—, or phenylene which is substituted or not substituted, B represents alkylene which is substituted or not substituted, phenylene, or aralkylene, and L represents —CONH—, —NHCONH—, —NHCOO—, —NHCO—, —OCONH—, —NH—, —COO—, —OCO—, —CO—, —O—, —S—, $—SO_2—$, $NHSO_2—$, or $—SO_2NH—$. Each of a, b, and c represents an integer of 0 or 1. Q represents a yellow coupler moiety obtained by eliminating one hydrogen atom from R, $R^1$, $R^2$, or X of the compound represented by Formula (1).

Examples of a non-color forming ethylenic monomer which gives the repeating unit $H_j$ and which is not coupled with the oxidized form of an aromatic primary amine developing agent are acrylic acid, α-chloroacrylic acid, α-alkylacrylic acid (for example, methacrylic acid), amides or esters derived from these acrylic acids (for example, acrylamide, methacrylamide, n-butylacrylamide, t-butylacrylamide, diacetoneacrylamide, methylacrylate, ethylacrylate, n-propylacrylate, n-butylacrylate, t-butylacrylate, iso-butylacrylate, 2-ethylhexylacrylate, n-octylacrylate, laurylacrylate, methylmethacrylate, ethylmethacrylate, n-butylmethacrylate, and β-hydroxymethacrylate), vinyl esters (for example, vinyl acetate, vinyl propionate, and vinyl laurate), acrylonitrile, methacrylonitrile, aromatic vinyl compounds (for example, styrene and its derivatives, for example, vinyl toluene, divinyl benzene, vinyl acetophenone, and sulfostyrene), itaconic acid, citraconic acid, crotonic acid, vinylidene chloride, a vinyl alkyl ester (e.g., vinyl ethyl ether), maleate, N-vinyl-2-pyrrolidone, N-vinyl pyridine, and 2- and -4-vinyl pyridine.

In particular, acrylaic esters, methacrylatic esters, and maleatic esters are preferable. Two or more non-color forming ethylene-based monomers can be used together. Examples of these monomers are methylacrylate and butylacrylate, butylacrylate and styrene, butylmethacrylate and methacrylic acid, and methylacrylate and diacetoneacrylamide.

An ethylene-based unsaturated monomer copolymerized with a vinyl-based monomer corresponding to Formula (11), as is known well in the field of polymer couplers, is selected to obtain good influences on the form of a copolymer to be formed, i.e., on a solid, liquid, or micellar state, physical properties, and/or chemical properties such as solubility (solubility in water or an organic solvent), compatibility with a binder (for example, gelatin) of a photographic colloidal composition, its flexibility, thermal stability, a coupling reactivity with the oxidized form of a developing agent, resistance to diffusion in the photographic colloid, and the like. These copolymers may be a random copolymer or a copolymer having a specific sequence (for example, a block copolymer or an alternating copolymer).

The number-average molecular weight of the yellow polymer coupler used in the present invention is generally on the order of several thousands to several hundred thousands. However, an oligomer-like polymer coupler having a number-average molecular weight of 5,000 or less can also be used.

The yellow coupler used in the present invention may be a lipophilic polymer soluble in an organic solvent (for example, ethyl acetate, butyl acetate, ethanol, methylene chloride, cyclohexanone, dibutylphthalate, or tricresyl phosphate), a hydrophilic polymer soluble in a hydrophilic colloid such as an aqueous gelatin solution, or a polymer having structure and nature able to form micelle in a hydrophilic colloid.

The yellow polymer coupler used in the present invention may be prepared by emulsifying and dispersing a lipophilic polymer coupler in an aqueous gelatin solution in the form of a latex after the lipophilic polymer coupler is obtained by polymerizing a vinyl-based monomer for giving a coupler unit represented by Formula (11) and is dissolved in an organic solvent. Alternatively, the yellow polymer coupler may be directly formed by emulsion polymerization.

A method described in U.S. Pat. No. 3,451,820 can be used as a method of emulsifying and dispersing a lipophilic polymer coupler in an aqueous gelatin solution in the form of a latex, and methods described in U.S. Pat.

Nos. 4,080,211 and 3,370,952 can be used in emulsion polymerization.

Practical examples of each substituent represented by Formula (2) are shown below.

(i) Examples of R are shown below:

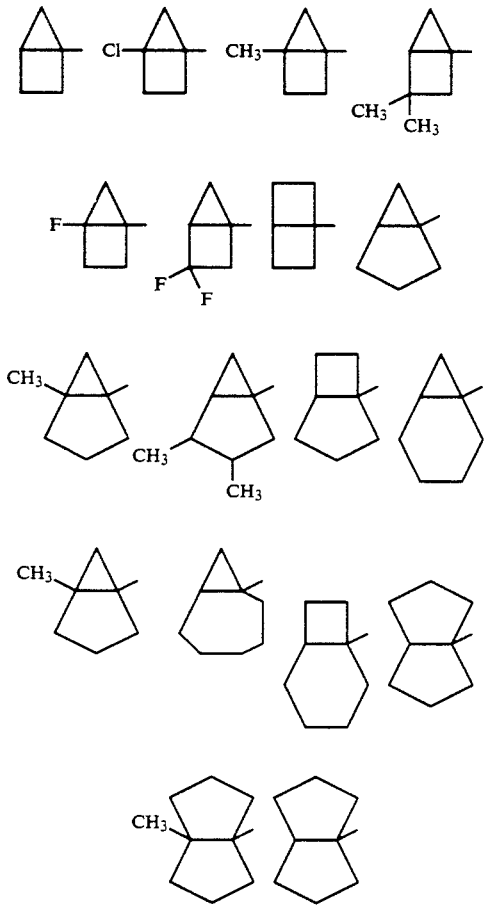

(ii) Examples of $R^3$ are shown below:

F, Cl, Br, I, $CH_3O$—, 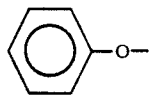 —O—

$CH_3O$— 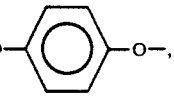 —O—, $CH_3$—, $C_2H_5$—, (i)-$C_3H_7$—, (t)-$C_4H_9$—, $CH_3OCH_2CH_2O$—, $CF_3$, $(CH_3)_2N$—, 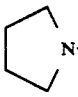 N—, (n)-$C_4H_9O$—, (n)-$C_{14}H_{29}O$—

(n)-$C_{16}H_{33}O$—, (t)-$C_8H_{17}$— 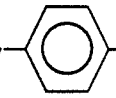 —O—,

-continued

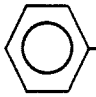 —$CH_2O$, (n)-$C_{12}H_{25}O$—, $C_{10}H_{21}CH(C_8H_{17})CH_2O$—

(iii) Examples of $R^4$ are shown below:

F, Cl, Br, I, —$OCH_3$, —$OC_{12}H_{25}$, —$OC_{16}H_{33}$,

—$COOCH_3$, —$COOC_{12}H_{25}$, —$COOCH(CH_3)COOC_{12}H_{25}$,

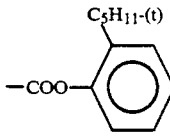

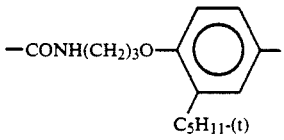

—$SO_2NH(CH_2)_3OC_{12}H_{25}$, —$SO_2N(C_8H_{17})_2$

—$SO_2N(CH_3)_2$, —$SO_2NHCOC_2H_5$,

—$NHCOC_{13}H_{27}$, —$NHCOCH(C_6H_{13})C_8H_{17}$,

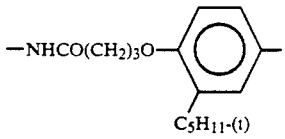

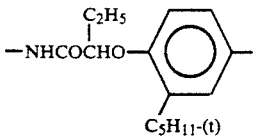

—$NHCOCH(CH_3)CH_2SO_2C_{12}H_{25}$, —$NHSO_2C_{16}H_{33}$,

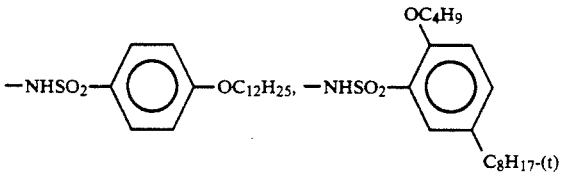

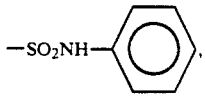

—$OCOC_{15}H_{31}$, —$OSO_2C_{16}H_{33}$, —$SO_2OC_{12}H_{25}$,

-continued
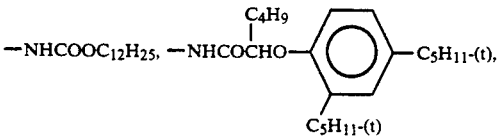
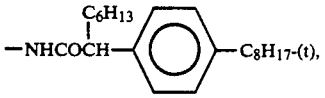
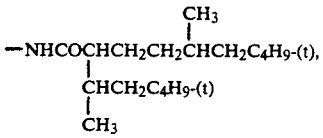
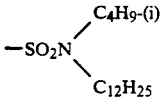
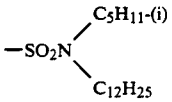
-continued
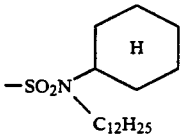
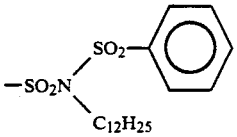
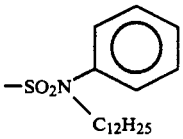
$-SO_2NHCONHC_{14}H_{29}$
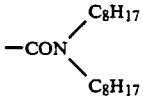
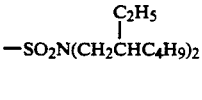
$-NHSO_2CH_3$ $-OCH_2COOC_{12}H_{25}$
$-CN$ $-NHSO_2C_4H_9$
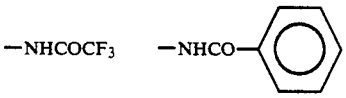
$-NHCOCF_3$
$-NHCOCH_3$
(iv) Examples of X are shown below:
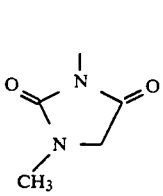
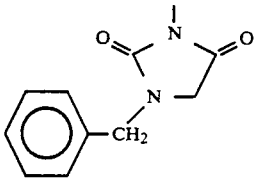
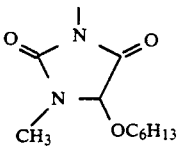
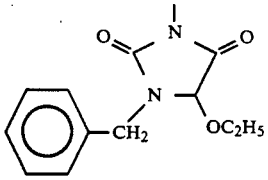
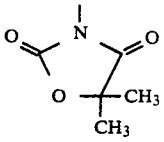
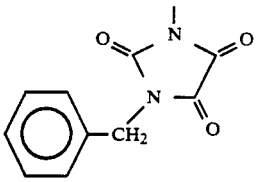
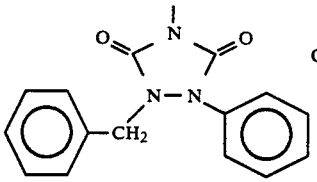
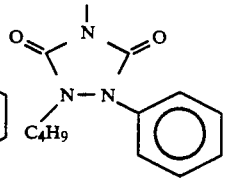
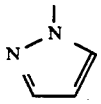
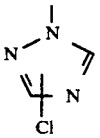
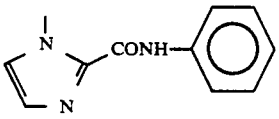
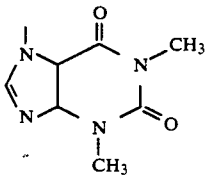

-continued
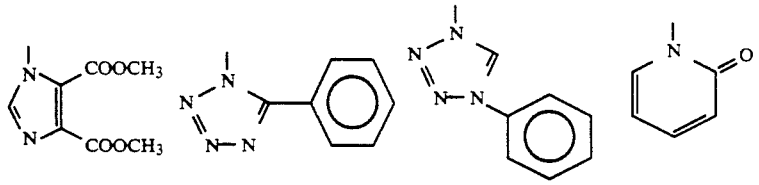
H Cl Br I —$OCOCH_3$ —$OSO_2CH_3$
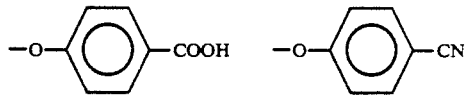
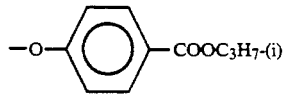
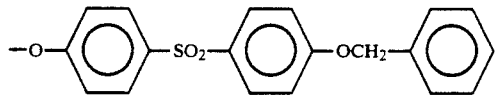
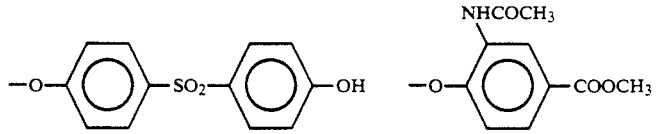
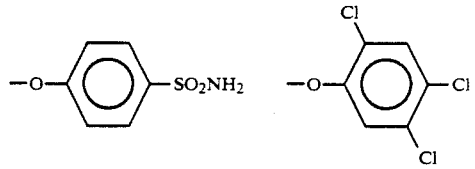
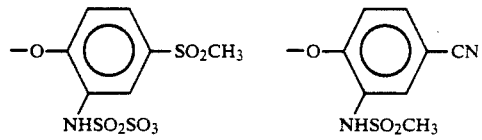
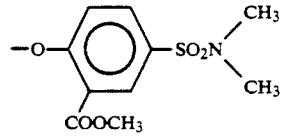
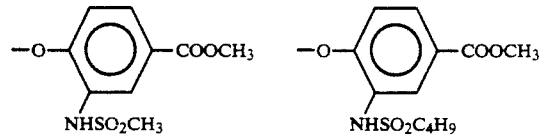

-continued
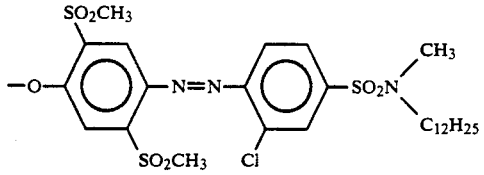
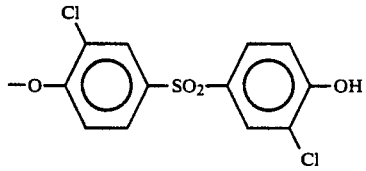
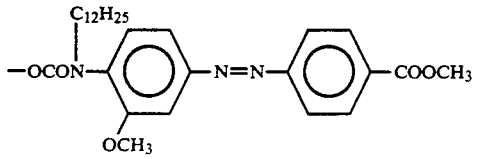
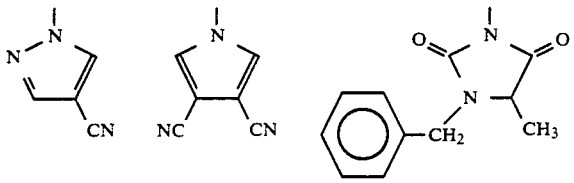
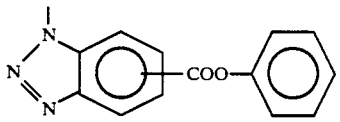
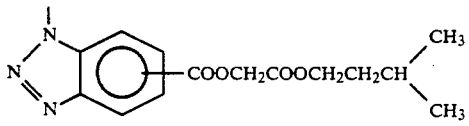
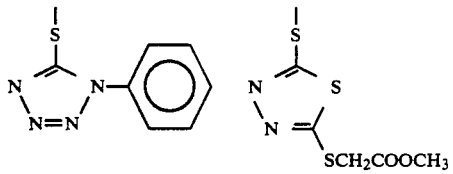
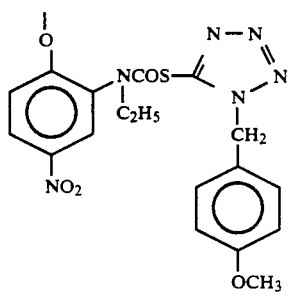
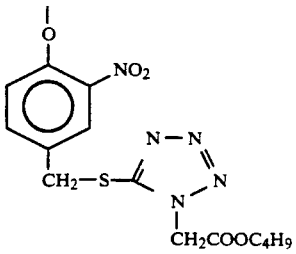

-continued
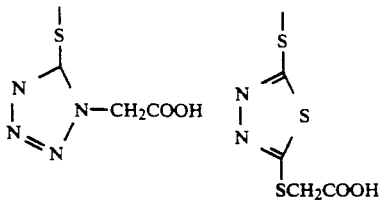
Practical examples of the yellow coupler according to the present invention are shown below, but the present invention is not limited to these examples.
(1)
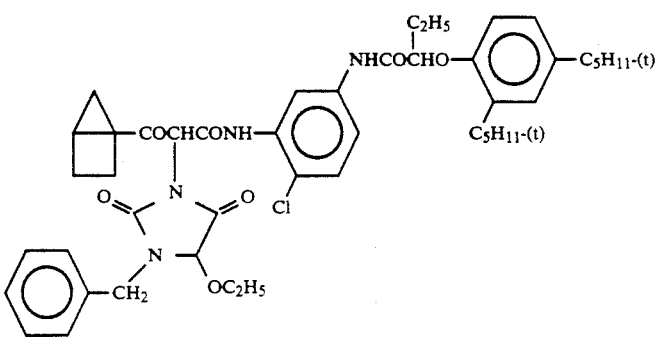
(2)
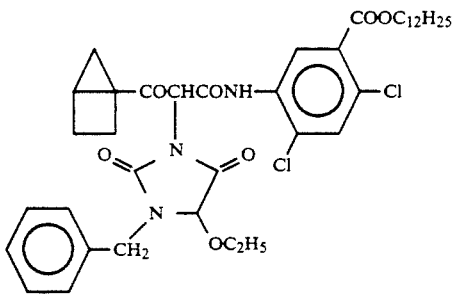
(3)
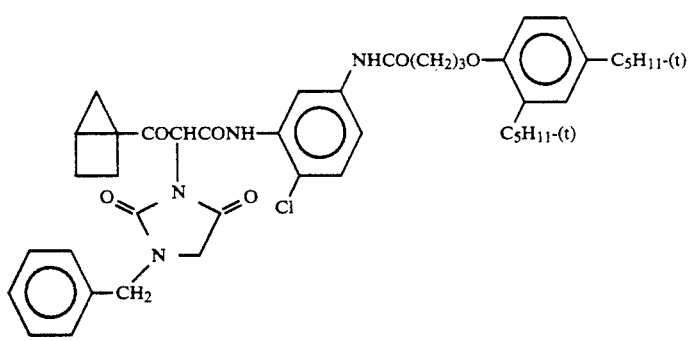
(4)
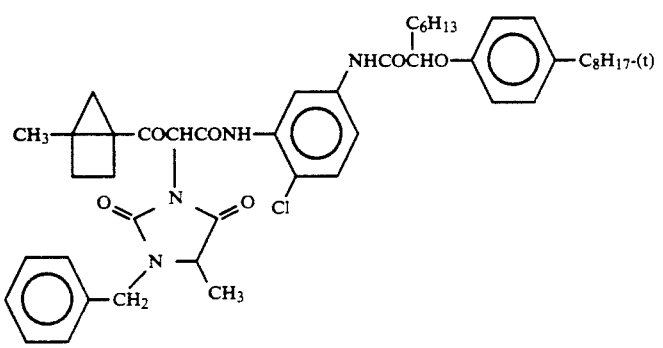

-continued
(5)
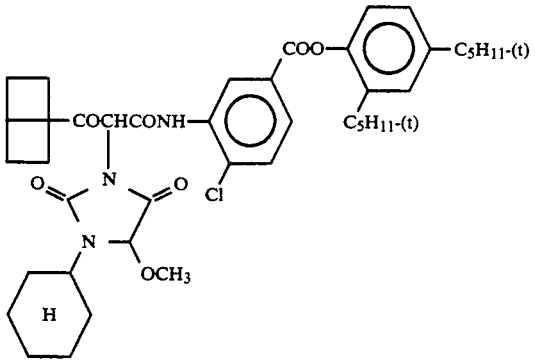
(6)
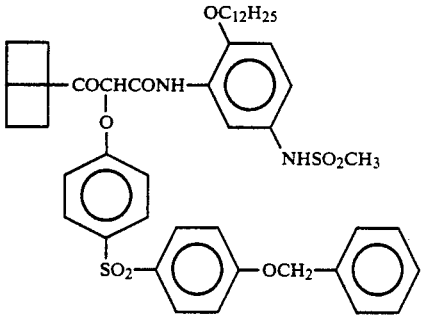
(7)
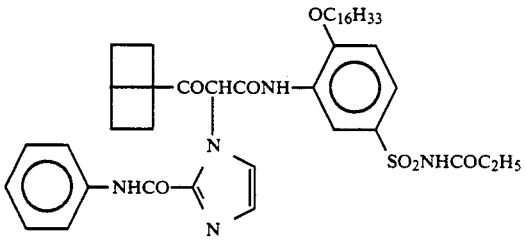
(8)
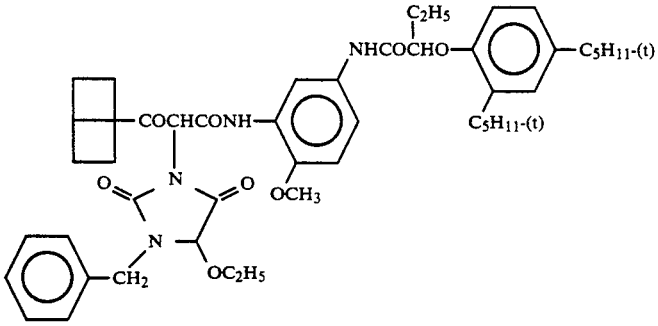
(9)
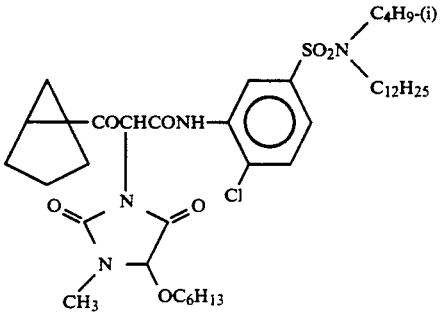

-continued
(10)
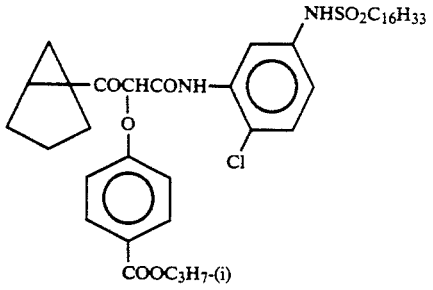
(11)
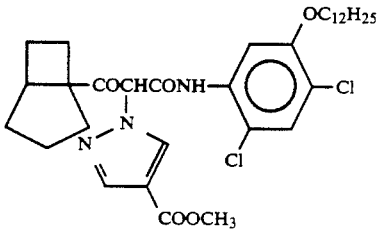
(12)
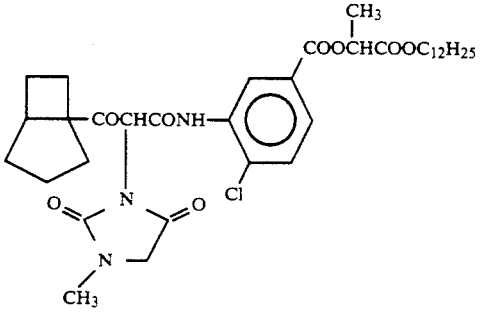
(13)
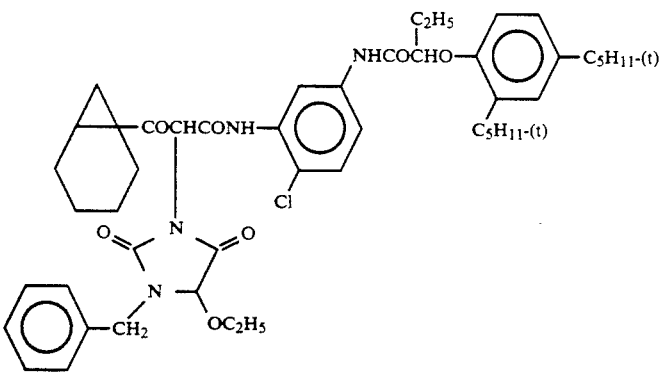
(14)
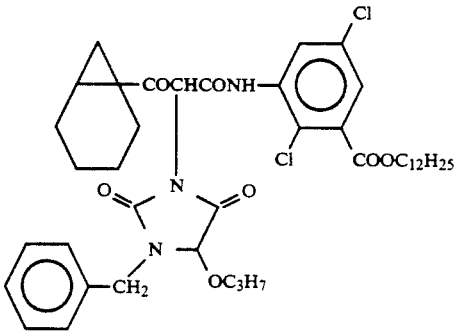

-continued
(15)
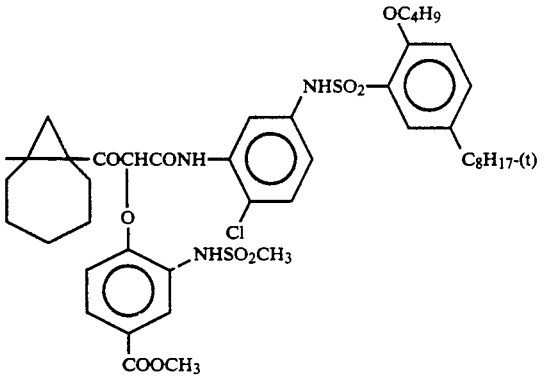
(16)
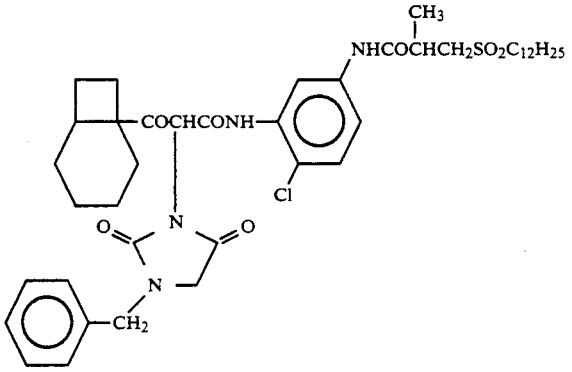
(17)
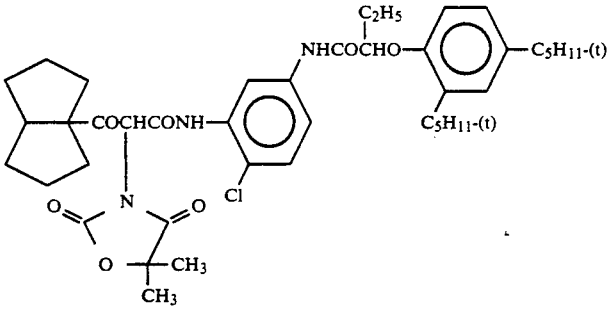
(18)
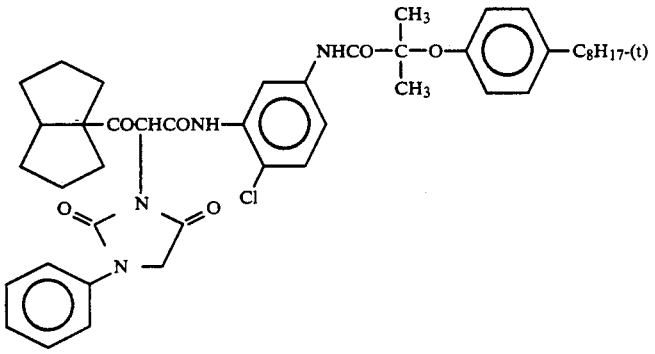

-continued
(19)
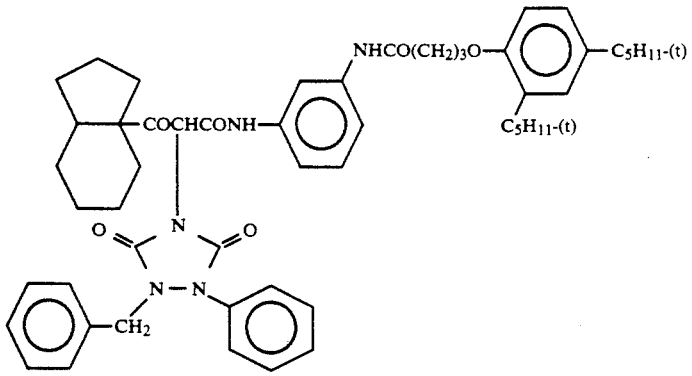
(20)
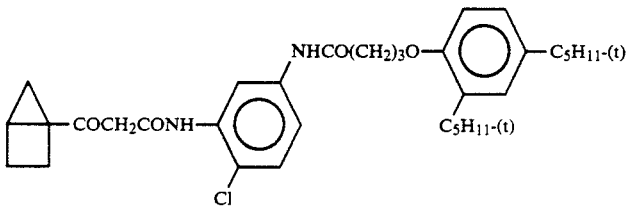
(21)
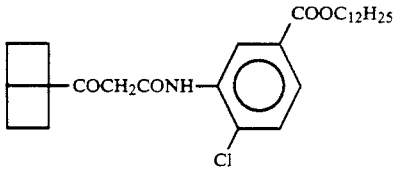
(22)
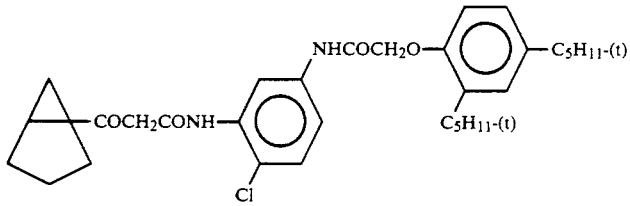
(23)
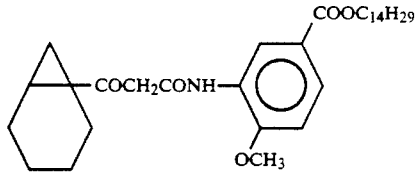
(24)
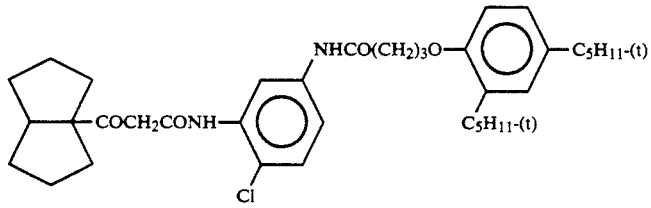
(25)
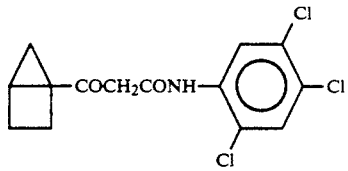

-continued
(26)
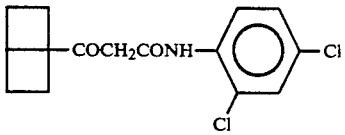
(27)
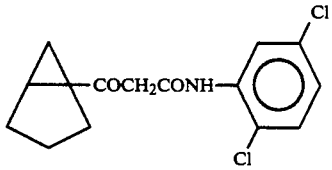
(28)
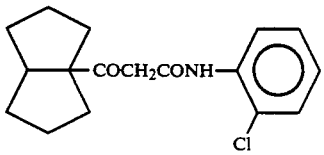
(29)
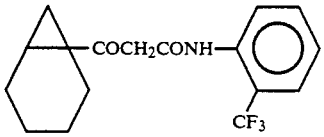
(30)
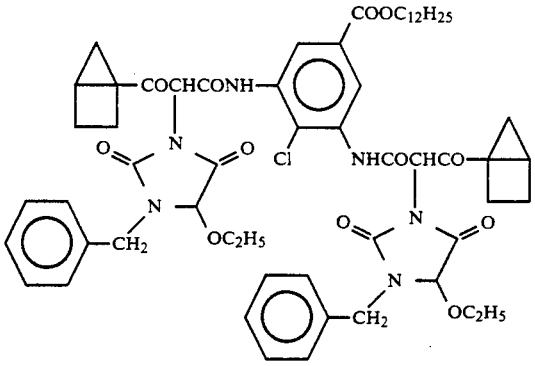
(31)
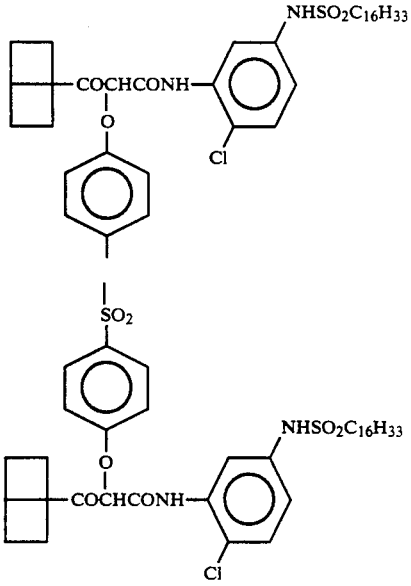

-continued
(32)
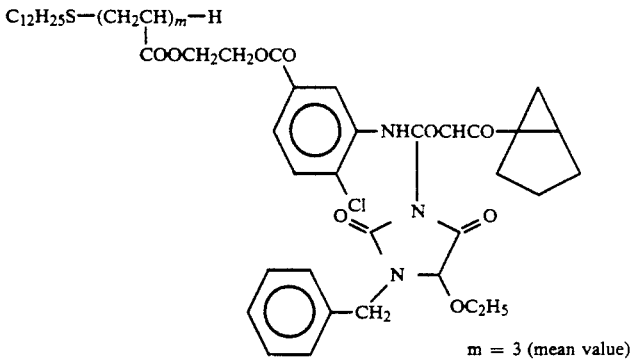
m = 3 (mean value)
(33)
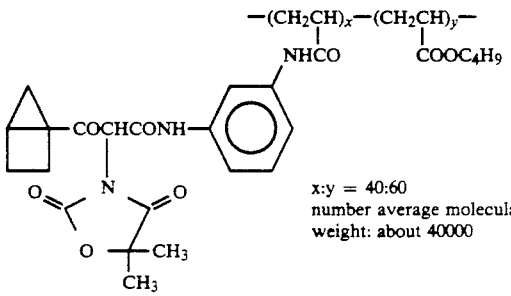
x:y = 40:60
number average molecular weight: about 40000
(34)
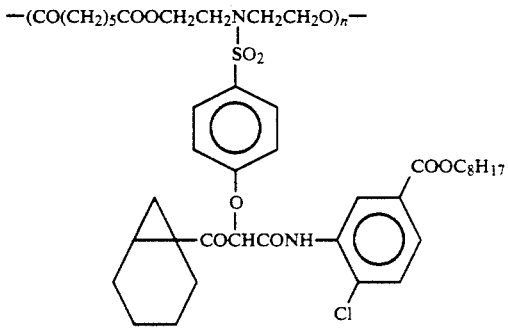
number average molecular weight: about 50,000
(35)
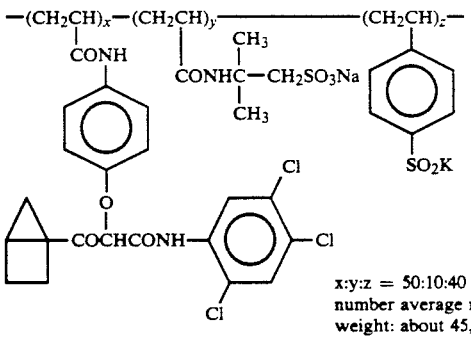
x:y:z = 50:10:40
number average molecular weight: about 45,000
The yellow coupler represented by Formula (1) according to the present invention can be synthesized in accordance with the following synthesis route:
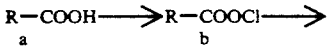
-continued
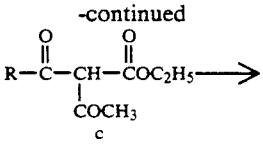

-continued

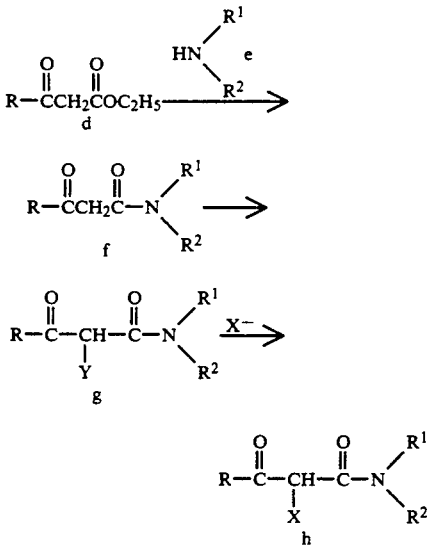

H—X of a split-off group in a solvent such as methylene chloride, chloroform, tetrahydrofuran, acetone, acetonitrile, dioxane, N-methylpyrrolidone, N,N'-dimethylimidazolidine-2-one, N,N-dimethylformamide, or N,N-dimethylacetamide at a reaction temperature of −20° C. to 150° C., and preferably −10° C. to 100° C. At this time, it is possible to use a base such as triethylamine, N-ethylmorpholine, DBU, tetramethylguanidine, potassium carbonate, sodium hydroxide, or sodium bicarbonate.

The β-ketoester d can also be synthesized in accordance with the following method.

(other method of synthesizing d)

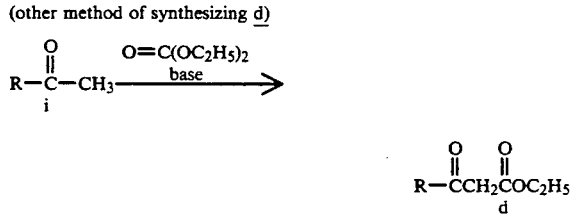

A compound a can be synthesized in accordance with a conventional known synthesis method. Typical synthesis methods (references) are presented below:

H. K. Hall, Macromol. 1971, 4(2), 139 W. Kirmse et al., Justus Liebigs Ann. Chem., 1981, 1394 A. C. Cope et al., J. Am. Chem. Soc., 1950, 72, 5228 R. N. McDonald, J. Org. Chem. 1970, 35(8)2669.

The synthesis of the compound b is performed by using, e.g., thionyl chloride or oxalyl chloride in the absence of a solvent or in a solvent such as methylene chloride, chloroform, carbon tetrachloride, dichloroethane, toluene, N,N-dimethylformamide, or N,N-dimethylacetamide. The reaction temperature is −20° C. to 150° C., and preferably −10° C. to 80° C.

The compound c is synthesized by converting, ethyl acetoacetate into an anion by using magnesium methoxide or the like and adding the compound b to the anion. The reaction is performed in the absence of a solvent or by using tetrahydrofuran or ethylether or the like, and the reaction temperature is normally −20° C. to 60° C., and preferably −10° C. to 30° C. The compound d is synthesized by reacting the compound c with a base, such as ammonia water, an aqueous $NaHCO_3$ solution, or an aqueous sodium hydroxide solution, in the absence of a solvent or in a solvent such as methanol, ethanol, tetrahydrofuran or acetonitrile. The reaction temperature is normally −20° C. to 50° C., and preferably −10° C. to 30° C.

The compound f is synthesized by reacting the compounds d and e in the absence of a solvent or in a hydrocarbon solvent. The reaction temperature is normally 100° C. to 200° C., and preferably 120° C. to 160° C. If X is not H, the split-off group X is introduced after chlorination or bromination to synthesize the compound h. The compound f is formed into a chloro substituted product g by using, e.g., sulfuryl chloride or N-chlorosuccinimide or into a bromo substituted product g by using, e.g., bromine or N-bromosuccinimide in a solvent such as dichloroethane, carbon tetrachloride, chloroform, methylene chloride, or tetrahydrofuran. At this time, the reaction temperature is −20° C. to 70° C., and preferably −10° C. to 50° C.

The coupler h of the present invention can be obtained by reacting the chloro substituted product g or the bromo substituted product g with a proton adduct The β-ketoester d can be obtained by reacting the ketone i and diethyl carbonate in the presence of a base (for example, NaH, $NaNH_2$, potassium t-butoxide, or sodium ethylate), in the absence of a solvent, or in a solvent such as tetrahydrofuran, dioxane, toluene, xylene, tetralin, or ether. The reaction temperature is 0° C. to 200° C., and preferably 50° C. to 150° C. In this case, it is preferable to use an excess of diethyl carbonate and the base with respect to the ketone i.

A synthesis example of the coupler according to the present invention will be described below. Synthesis Example-Synthesis of exemplified coupler (1).

18.4 g of oxalylchoride were dropped in a mixture of 13.5 g of bicyclo[2.1.0]pentane-1-carboxylic acid synthesized by a synthesis method described in H. K. Hall, Macromol. 1971, 4(2), page 139, 1 ml of N,N-dimethylformamide, and 100 ml of methylene chloride at room temperature over 30 minutes under stirring. After the dropping, the resultant mixture was stirred for two hours and condensed under reduced pressure to obtain 15.7 g of acid chloride.

80 ml of methanol were dropped in a mixture of 2.9 g of magnesium and 1.2 ml of carbon tetrachloride at room temperature over 30 minutes, and the mixture was refluxed under heating for two hours. 14.8 g of ethyl acetoacetate were dropped over 30 minutes, and the mixture was refluxed under heating for two hours. After the methanol was perfectly distilled off under reduced pressure, 200 ml of tetrahydrofuran were added to the reaction product, and 22 g of the acid chloride obtained earlier were dropped at room temperature over 30 minutes under stirring. After the dropping, the resultant mixture was stirred for 30 minutes, and 300 ml of ethyl acetate were added to it. The reaction product was washed with diluted sulfuric acid water and then with water. After the organic layer was dried by sodium sulfate anhydride, the solution was condensed under reduced pressure to obtain 25.5 g of an oily product. The total weight of the oily product was dissolved in 100 ml of ethanol, and 40 ml of 30% ammonium water were dropped in the resultant solution at room temperature over 10 minutes. Thereafter, the obtained solution was stirred for an hour, and 300 ml of ethyl acetate were added to the solution. The reaction product was extracted and washed with diluted sulfuric acid water and then with water. The organic layer was dried by sodium sulfate anhydride and condensed under reduced pressure to obtain 20.0 g of an oily product of ethyl bicyclo[2.1.0]pentane-1-carbonylacetate (β-ketoester product).

13.7 g of the β-ketoester and 17.0 g of N-(3-amino-4-chlorophenyl)-2-(2,4-di-t-pentylphenoxy)butaneamide were stirred under heating at a temperature of 140° C. under reduced pressure obtained by an aspirator for five hours. The reaction solution was purified by column chromatography using silica gel as a carrier and a solvent mixture of ethyl acetate and n-hexane as a developing solution to obtain 24.4 g of a viscous oily product of β-ketoacetamide product (corresponding to compound f).

14.5 g of the β-ketoacetamide were dissolved in 200 ml of methylene chloride, and 3.4 g of sulfuryl chloride were dropped under ice cooling over 10 minutes. After the resultant solution was stirred for 30 minutes, the reaction solution was washed with water, dried by calcium chloride, and condensed to obtain a chloride (corresponding to g in Formula 26) of the β-ketoacetamide. The synthesized chloride was dissolved in 50 ml of N,N-dimethylformaldehyde, and the resultant solution was dropped in a solution containing 12.8 g of 1-benzyl-5-ethoxyhydantoin, 7.6 ml of triethylamine, and 50 ml of N,N-dimethylformamide at room temperature over 30 minutes.

Thereafter, the reaction was continued at 40° C. for four hours, and the reaction solution was extracted with 300 ml of ethyl acetate and washed with water. The resultant material was washed with 300 ml of a 2% aqueous triethylamine solution and neutralized by diluted hydrochloric acid. After the organic layer was dried by sodium sulfate anhydride, the solvent was distilled off to obtain an oily product. This oily product was separated and purified by column chromatography using silica gel as a carrier and a solvent mixture of ethyl acetate and n-hexane as a developing solution. The corresponding fraction was condensed under reduced pressure to obtain 17.5 g of a viscous oily product of an exemplified coupler (1). The structure of the compound was confirmed by a MASS spectrum, an NMR spectrum, and elementary analysis.

Although the coupler of the present invention can be used in any layer of the light-sensitive material, it is preferably used in a blue-sensitive silver halide emulsion layer or a non-light-sensitive layer adjacent to that layer.

The amount of the yellow coupler used in the present invention falls within the range of preferably 0.05 to 5.0 mmol/m$^2$, and more preferably 0.2 to 2.0 mmol/m$^2$.

When the yellow coupler of the present invention is used in light-sensitive layers, the molar ratio of the coupler to a silver halide is preferably 1:0.1 to 1:200, and more preferably 1:2 to 1:200. When the yellow coupler of the present invention is used in a non-light-sensitive layer, it is used in an amount of 2.0 to 0.01 mol with respect to a silver halide in an adjacent blue-sensitive silver halide emulsion layer.

The coupler according to the present invention may be used singly or together with another yellow coupler (for example, a pivaloylacetanilide-based yellow coupler or a benzoylacetanilide-based yellow coupler). When the coupler of the present invention is used in combination with another yellow coupler, the amount of the coupler of the present invention falls within the range of 10 mol % or more, and more preferably 40 mol % or more with respect to the total content of these yellow couplers.

The present invention can be applied to various color light-sensitive materials. Representative examples are color negative films for general purposes or movies, color reversal films for slides or TV, color paper, color positive film, and color reversal paper. The coupler of the present invention can also be applied to coupler-in-developer-type color reversal films when it is dissolved in a color developer.

Techniques and materials which can be used together with the color photographic light-sensitive material of the present invention are described in portions of JP-A-3-161745 described below.

1. Layer arrangement: page 28, lower left column, line 1 to page 29, upper right column, line 7
2. Silver halide emulsion: page 29, upper right column, line 8 to page 30, upper right column, line 12
3. Yellow coupler: page 30, lower right column, lines 5 to 11
4. Magenta coupler: page 30, lower right column, line 12 to page 31, line 3
5. Cyan coupler: page 31, upper left column, lines 4 to 16
6. Polymer coupler: page 31, upper left column, line 17 to upper right column, line 1
7. Functional coupler: page 31, upper right column, line 2 to lower right column, line 5
8. Antiseptic and mildewproofing agents: page 32, upper right column, lines 10 to 17
9. Formalin scavenger: page 30, lower left column, lines 16 to 20
10. Other additives: page 35, lower right column, line 19 to page 36, upper left column, line 14, and page 30, upper right column, line 13 to lower left column, line 15
11. Dispersion method: page 31, lower right column, line 8 to page 32, upper right column, line 9
12. Support: page 32, lower left column, lines 4 to 6
13. Thickness and physical properties of film: page 32, lower left column, line 7 to lower right column, line 10
14. Color development process: page 32, lower right column, line 15 to page 33, lower right column, line 16
15. Desilvering process: page 32, lower right column, line 17 to page 35, upper left column, line 16
16. Automatic developing machine: page 35, lower left column, line 17 to upper right column, line 5
17. Washing/stabilizing process: page 35, upper right column, line 6 to lower right column, line 15

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide light-sensitive material of the present invention can be applied to thermal development light-sensitive materials described in, e.g., U.S. Pat. No. 4,500,626, JP-A-60-133449, JP-A-59-218443, JP-A-61-238056, and EP 210,660A2.

The present invention will be described in more detail below by way of its examples, but the present invention is not limited to these examples.

The structures of comparative couplers used in the following examples are shown below:

Comparative coupler
YC-1
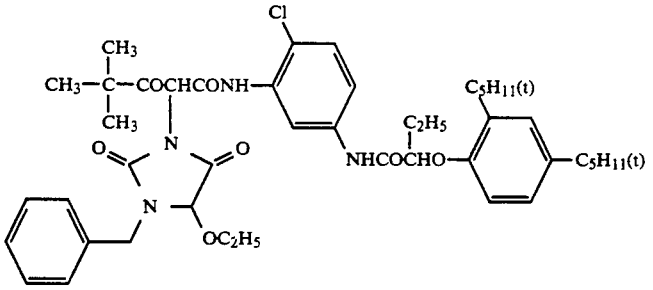
YC-2
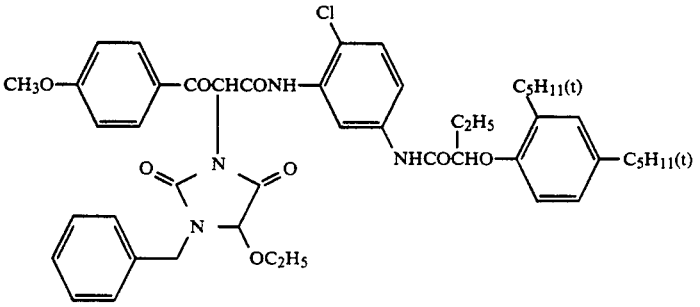
YC-3
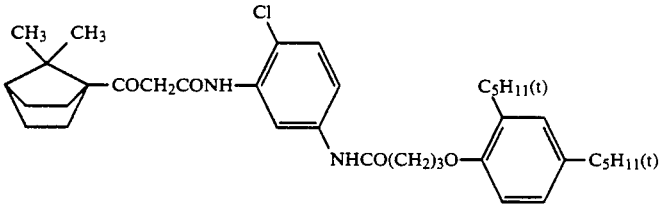
YC-4
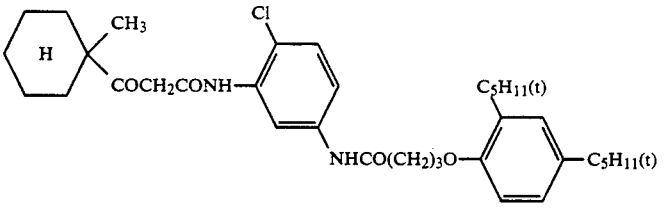
YC-5
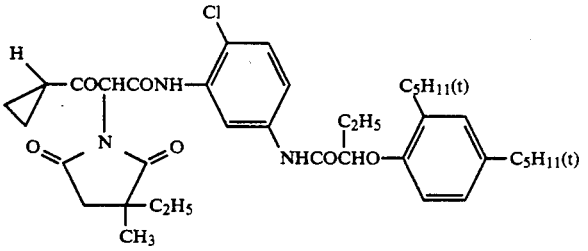
YC-6
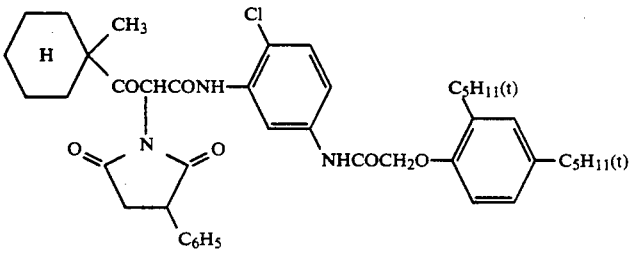

-continued
Comparative coupler
YC-7
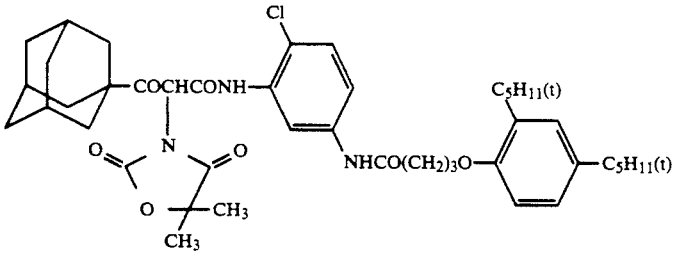
YC-8
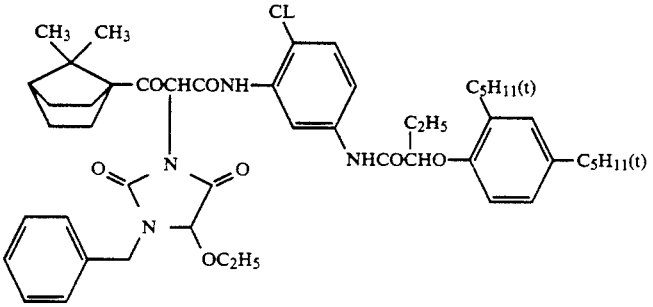
YC-9
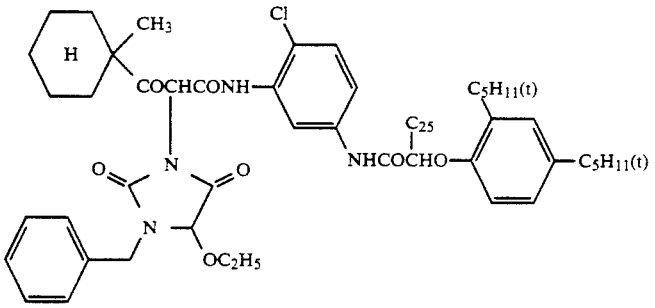
YC-10
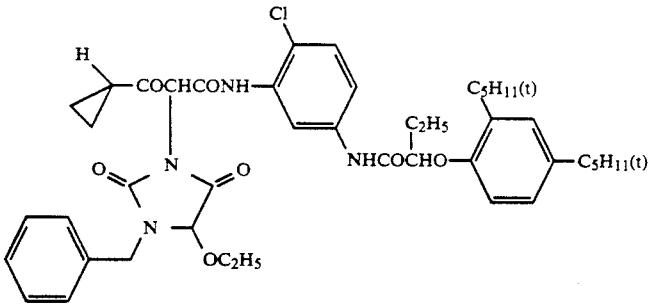
YC-11
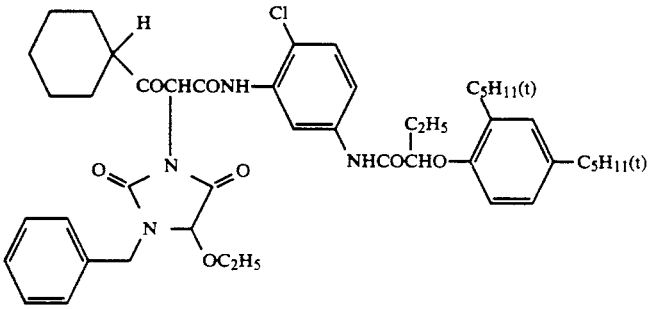

-continued

Comparative coupler

YC-12

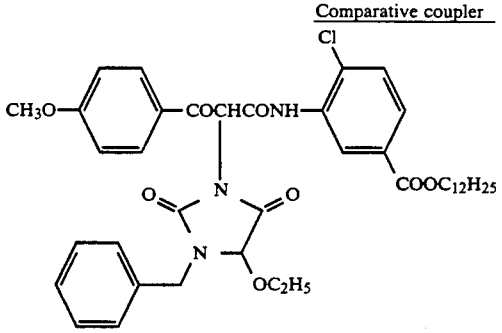

YC-13

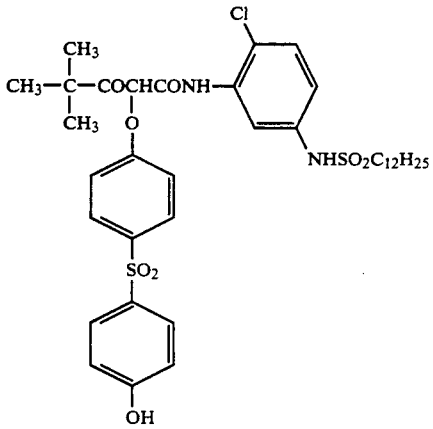

The numbers representing the couplers of the present invention used in the following examples are numbers assigned to the exemplified compounds.

EXAMPLE 1

18.3 g of the comparative coupler YC-1 were weighed out and dissolved in 9.1 cc of tricresyl phosphate and 20 cc of ethyl acetate. 2.3 g of sodium dodecylbenzenesulfonate were added to 500 g of a 10% aqueous gelatin solution, and the total weight of the above coupler solution was added to cause emulsion dispersion. A silver chlorobromide emulsion (silver bromide: 65 mol %) was added to the resultant emulsion dispersion so that the molar ratio of the silver halide to the coupler was 3.0. A 10% aqueous gelatin solution and water were added to the mixture so that the final amount of a coating solution was 2,000 cc and the final gelatin concentration was 5%. This coating solution was applied to a subbed triacetyl cellulose support so that the coating amount of the coupler was 1 mmol/$m^2$. A gelatin protective layer containing sodium 1-oxy-3,5-dichloro-s-triazinate as a hardening agent was simultaneously coated.

In addition, samples were formed following the same procedures as described above except that the comparative coupler YC-1 was replaced with equal molar quantities of other comparative couplers and the couplers of the present invention.

These samples were subjected to sensitometry as follows. First, a sensitometer (FWH type available from Fuji Photo Film, Co. Ltd., color temperature of light source=3,200 K.) was used to apply gradition exposure to each sample. The exposure in this case was performed with an exposure amount of 250 CMS for an exposure time of 0.1 sec. The exposed samples were subjected to the following processes in the steps of Table 1 below. The compositions of the respective processing solutions are summarized in Tables 2 and 3 below.

TABLE 1

| Processing step | Temperature | Time |
|---|---|---|
| Color development | 35° C. | 2 min. |
| Bleach-fixing | 35° C. | 1 min. 30 sec. |
| Washing | 35° C. | 2 min. |
| Drying | 60° C. | 10 min. |

TABLE 2

| Color developing solution | |
|---|---|
| Water | 700 ml |
| Ethylenediaminetetraacetic acid | 3.0 g |
| Triethanolamine | 12.0 g |
| Potassium bromide | 1.0 g |
| Potassium carbonate | 27.0 g |
| Sodium sulfite | 0.1 g |
| Disodium-N,N-bis(sulfonateethyl) hydroxylamine | 8.0 g |
| N-ethyl-N-(β-methanesulfonamidoethyl)-3-methyl-4-aminoanilinesulfate | 5.0 g |
| Water to make | 1,000 ml |
| pH (25° C.) | 10.05 |

TABLE 3

| Bleach-fixing solution | |
|---|---|
| Water | 600 ml |
| Ammonium thiosulfate (700 g/l) | 100 ml |
| Iron(III) ammonium ethylenediamine tetraacetate | 55 g |
| Ethylenediaminetetraacetic acid | 5 g |
| Ammonium bromide | 40 g |
| Nitric acid (67%) | 30 g |
| Water to make | 1,000 ml |
| pH (25° C.) | 5.8 |

TABLE 3-continued

| Bleach-fixing solution |
|---|
| (adjusted by acetic acid or ammonia water) |

Maximum color densities Dmax were read from the sensitometric curves in blue region of the resultant samples. The light-fastnesses of the samples were evaluated by the ratios of remaining dye images at an initial density of 1.0 in the sensitometric curves upon radiation of the samples with 75,000-lux xenon light for seven days. Fading values of the samples under humid/hot conditions were also read from the sensitometric curves after the samples were stored at a constant temperature of 60° C. and a constant humidity of 70% RH for three months. The results are summarized in Tables 4 and 5 below. A coupler having a higher Dmax can be regarded as an excellent coupler having a better color forming property. A coupler having a higher ratio of remaining dye image is regarded as an excellent coupler which causes less fading.

TABLE 4

| Coupler | Maximum color density Dmax | Dye image stability (remaining ratio) Radiation of xenon light | Stored under 60° C.-70% | Remarks |
|---|---|---|---|---|
| YC-1 | 1.47 | 69% | 74% | Comparative example pivaloyl-based-coupler |
| YC-2 | 1.73 | 30 | 46 | Comparative example benzoyl-based coupler |
| YC-3 | 0.68 | — | — | Comparative example coupler 28 described in USRe 27848 |
| YC-4 | 0.87 | — | — | Comparative example Coupler 30 described in USRe 27848 |
| YC-5 | 1.29 | 7 | 12 | Comparative example Coupler (19) described in JP-A-47-26133 |
| YC-6 | 1.00 | 18 | 14 | Comparative example Coupler (21) described in JP-A-47-26133 |
| YC-7 | 1.25 | 85 | 82 | Comparative example Coupler 2 described in JP-A-56-87041 |
| YC-8 | 1.35 | 79 | 80 | Comparative example 2-equivalent coupler similar to YC-3 |
| YC-9 | 1.15 | 73 | 80 | Comparative example 2-equivalent coupler similar to YC-4 |
| YC-10 | 1.68 | 13 | 9 | Comparative example Coupler similar to YC-5 |
| YC-11 | 1.49 | 17 | 15 | Comparative example Coupler similar to YC-6 |

TABLE 5

| Coupler | Maximum color forming density Dmax | Dye image stability (remaining ratio) Radiation of xenon light | Stored under 60° C.-70% | Remarks |
|---|---|---|---|---|
| (1) | 1.98 | 73% | 82% | Present Invention |
| (4) | 1.91 | 79 | 91 | Present Invention |
| (8) | 1.79 | 68 | 79 | Present Invention |
| (9) | 1.83 | 81 | 90 | Present Invention |
| (12) | 1.68 | 75 | 85 | Present Invention |
| (13) | 1.65 | 91 | 92 | Present Invention |
| (15) | 1.61 | 88 | 87 | Present Invention |
| (16) | 1.58 | 84 | 88 | Present Invention |
| (17) | 1.55 | 92 | 93 | Present Invention |
| (19) | 1.51 | 90 | 95 | Present Invention |

As is apparent from Table 4, although a pivaloylacetanilide-based coupler represented by the comparative coupler YC-1 has a certain dye fastness, it does not have a sufficiently high maximum color forming density. A further improvement of this coupler is required. On the other hand, although a benzoylacetanilide-based coupler represented by the comparative coupler YC-2 has a relatively high maximum color density, the dye image fades greatly upon light radiation or storage under humid/hot conditions. A further improvement of this coupler is also required.

The couplers represented by YC-3 to YC-11 are couplers described in U.S. Pat. No. Re. 27,848, JP-A-47-26133, and JP-A-56-87041, or couplers similar to them. Either the maximum color density or dye fastness of some of these couplers is better than that of YC-1 or YC-2. However, none of these couplers satisfy both of excellent color forming properties and prevention of fading. Although the coupler YC-10 has a relatively high color density, it is poor in color reproducibility since the resultant dye image is orange in color.

The yellow coupler YC-1 which has been considered preferable in color reproduction and used in color print materials has less orangish color than that of YC-2 often used in materials for photography. However, the coupler still keeps a considerable amount of orangish color and therefore is not satisfactorily preferable in reproducing yellow or greenish yellow. The coupler of the present invention, on the other hand, is much less orangish than YC-1 but exhibits bright yellow. This indicates that the coupler of the present invention can further improve reproducibility of yellow or greenish yellow.

As shown in Table 5, the couplers (1), (4), (8), and (9) according to the present invention have higher maximum color densities than that of the highly active benzoylacetanilide-based coupler (YC-2) and have a dye fastness equal to or better than the pivaloylacetanilide-based coupler (YC-1). Of the couplers (1), (4), (8), and (9), the couplers (1) and (4) exhibit higher maximum color densities.

On the other hand, the couplers (12), (13), (15), (16), (17), and (19) according to the present invention have only slightly higher color forming densities than that of the pivaloylacetanilide-based coupler (YC-1). However, the couplers (12), (13), (15), (16), (17), and (19) have better dye stability than the coupler (YC-1) upon light radiation or storage under humid/hot conditions. Of these couplers, the couplers (13), (17), and (19) have excellent dye fastnesses.

As described above, the couplers according to the present invention are regarded as excellent couplers having satisfactory, improved levels in both the color forming property and dye stability.

EXAMPLE 2

15.0 g of the comparative coupler YC-2 were weighed out and dissolved in 6.0 cc of tricresyl phosphate and 20 cc of ethyl acetate. 2.3 g of sodium dodecylbenzene sulfonate were added to 500 g of a 10% aqueous gelatin solution, and the total weight of the coupler solution was added to cause emulsion dispersion. A silver bromoiodide emulsion (silver iodide: 8 mol %) was added to the resultant emulsion dispersion so that the molar ratio of the silver halide to the coupler was 4.0. A 10% aqueous gelatin solution and water were added to the mixture so that the final amount of a coating solution was 2,000 cc and the final gelatin concentration was 5%. This coating solution was applied to a subbed triacetyl cellulose support so that the coating amount of the coupler was 1 mmol/m$^2$. A gelatin protective layer containing 1,2-bis(vinylsulfonylacetamido)ethane as a hardening agent was simultaneously coated.

In addition, samples were formed following the same procedures as described above except that the comparative coupler YC-2 was replaced with equal molar quantities of other comparative couplers and the couplers of the present invention.

These samples were subjected to sensitometry as follows. First, a sensitometer (FWH type available from Fuji Photo Film. Co. Ltd., color temperature of light source=3,000K) was used to apply gradation exposure to each sample. The exposure in this case was performed with an exposure amount of 5 CMS for an exposure time of 0.1 sec. The exposed samples were subjected to the following processes in the steps of Table 6 below. The compositions of the respective processing solutions are summarized in Tables 7 to 9 below.

TABLE 6

| Processing step | Temperature | Time |
|---|---|---|
| Color development | 38° C. | 3 min. 15 sec. |
| Bleaching | 38° C. | 6 min. 30 sec. |
| Washing | 38° C. | 2 min. |
| Fixing | 38° C. | 4 min. 30 sec. |
| Washing | 35° C. | 5 min. |
| Drying | 60° C. | 5 min. |

TABLE 7

| Color developing solution | |
|---|---|
| Water | 700 ml |
| Ethylenediaminetetraacetic acid | 2.0 g |
| Sodium sulfite | 4.0 g |
| Potassium carbonate | 30.0 g |
| Potassium bromide | 1.4 g |
| Hydroxyaminesulfate | 8.0 g |
| 4-(N-ethyl-N-(β-hydroxyethylamino)-methylanilinesulfate | 4.5 g |
| Water to make | 1,000 ml |
| pH (25° C.) | 10.05 |

TABLE 8

| Bleaching solution | |
|---|---|
| Water | 600 ml |
| Ammonium thiosulfate (700 g/l) | 100 g |
| Iron(III) sodium ethylenediamine tetraacetate trihydrate | 100 g |
| Disodium ethylenediaminetetraacetate | 10 g |
| Ammonium bromide | 30 g |
| Ammonia water (27%) | 6.5 g |
| Water to make | 1,000 ml |
| pH (25° C.) | 6.0 |

TABLE 9

| Fixing solution | |
|---|---|
| Water | 600 ml |
| Disodium ethylenediaminetetraacetate | 0.5 g |
| Sodium sulfite | 7.0 g |
| Sodium bisulfite | 5.5 g |
| Ammonium thiosulfate (700 g/l) | 170 g |
| Water to make | 1,000 ml |
| pH (25° C.) (adjusted by acetic acid or ammonia water) | 6.7 |

Maximum color densities Dmax were read from the sensitometric curves in blue ranges of the resultant samples. The dye fastnesses of the samples were evaluated by reading the ratios of remaining dye images of the Dmax portions from the sensitometric curves after the samples were stored at a temperature of 60° C. and a humidity of 70% RH for 14 days. Results are summarized in Table 10. The couplers having high maximum color densities and high ratios of remaining dye images are regarded as excellent coupler.

TABLE 10

| Coupler | Maximum color density Dmax | Dye image stability (remaining ratio) under 60° C.-70% | Remarks |
|---|---|---|---|
| YC-2 | 1.68 | 67% | Benzoyl-based coupler of comparative example |
| YC-12 | 1.75 | 59% | Benzoyl-based coupler of comparative example |
| YC-13 | 1.44 | 60% | Pivaloyl-based coupler of comparative example |

TABLE 10-continued

| Coupler | Maximum color density Dmax | Dye image stability (remaining ratio) under 60° C.-70% | Remarks |
|---|---|---|---|
| (2) | 2.04 | 88% | Present invention |
| (6) | 1.95 | 81% | Present invention |
| (9) | 1.98 | 91% | Present invention |
| (12) | 1.88 | 85% | Present invention |
| (14) | 1.79 | 94% | Present invention |

As is apparent from Table 10, the couplers of the present invention have higher color densities than that of the comparative benzoylacetanilide-based couplers YC-2 and YC-12 known as highly active couplers and the comparative coupler YC-13 known as a relatively highly active coupler among pivaloylacetanilide-based couplers. The couplers of the present invention exhibit better results than the comparative couplers in fading of dye images upon storage under humid/hot conditions.

As described above, the couplers according to the present invention are regarded as excellent couplers having satisfactory, improved levels in both the color forming property and dye stability.

EXAMPLE 3

After corona discharge was performed on the surface of a paper support double-side-laminated by polyethylene. a gelatin subbing layer containing sodium dodecylbenzene sulfonate was formed on the surface, and various photographic constituting layers were coated to prepare a multilayered color photographic paper (sample 1) having the following layer structure. The coating solutions were prepared as follows. Preparation of coating solution for fifth layer:

50.0 cc of ethyl acetate and 14.0 g of a solvent (Solv-6) are added to 32.0 g of the cyan coupler (ExC), 3.0 g of the dye image stabilizer (Cpd-2), 2.0 g of the dye image stabilizer (Cpd-4), 18.0 g of the dye image stabilizer (Cpd-6), 40.0 g of the dye image stabilizer (Cpd-7), and 5.0 g of the dye image stabilizer (Cpd-8), and dissolved. The resultant solution was added to 500 cc of a 20% aqueous gelatin solution containing 8 cc of sodium dodecylbenzenesulfonate. The mixture was emulsion-dispersed by an ultrasonic homogenizer to prepare an emulsion dispersion. On the other hand, a silver chlorobromide emulsion (cubic, a 1:4 mixture (Ag molar ratio) of a large-size emulsion having an average grain size of 0.58 μm and a small-size emulsion having that of 0.45 μm. The variation coefficients of grain size distributions of the two emulsions were 0.09 and 0.11, respectively. Each emulsion locally contained 0.6 mol % of AgBr in a portion of the surface of each grain) was prepared. The following red-sensitive sensitizing dye E had been added to the large-size emulsion in an amount of $0.9\times10^{-4}$ mol per mol of silver and to the small-size emulsion in an amount of $1.1\times10^{-4}$ mol per mol of silver. Chemical ripening of the emulsion was performed by adding a sulfur sensitizer and a gold sensitizer. This red-sensitive silver chlorobromide emulsion in the above emulsion dispersion were mixed and dissolved, and preparing the coating solution of the fifth layer having a composition given below.

The coating solutions of the first to fourth layers and those of the sixth and seventh layers were prepared following the same procedures as in the preparation of the coating solution of the fifth layer. H-1 and H-2 were used as gelatin hardening agents of the respective layers.

Cpd-10 and Cpd-11 were added to each layer so that the total content was 25.0 mg/m$^2$ and 50.0 mg/m$^2$, respectively.

Spectral sensitizing dyes shown in Tables 11 to 13 below were used for silver chlorobromide emulsions of the light-sensitive emulsion layers.

TABLE 11

Red-sensitive emulsion layer

Sensitizing dye A

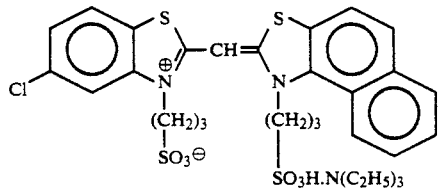

and sensitizing dye B

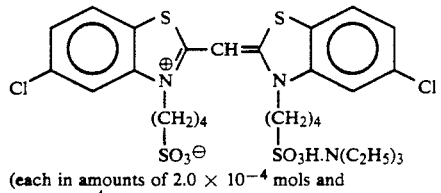

(each in amounts of $2.0\times10^{-4}$ mols and $2.5\times10^{-4}$ mols per mol of a silver halide for large- and small-size emulsions, respectively)

TABLE 12

Green-sensitive emulsion layer

Sensitizing dye C

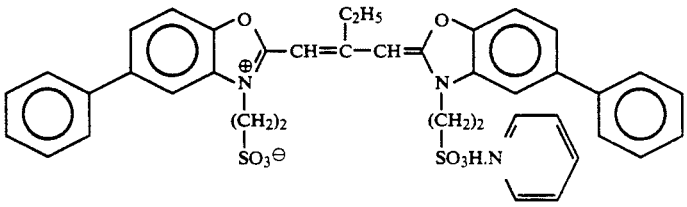

($4.0\times10^{-4}$ mols and $5.6\times10^{-4}$ mols per mol of a silver halide for large- and small-size emulsions, respectively) and Sensitizing dye D TABLE 12-continued Green-sensitive emulsion layer

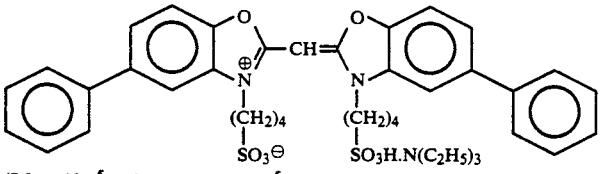

($7.0 \times 10^{-5}$ mols and $1.0 \times 10^{-5}$ mols per mol of a silver halide for large- and small-size emulsions, respectively)

TABLE 13

Green-sensitive emulsion layer

Sensitizing dye E

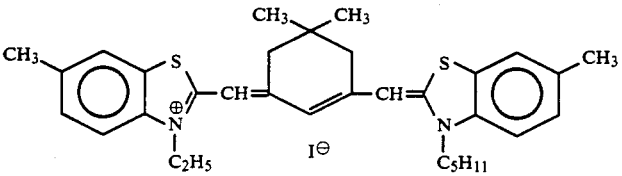

($0.9 \times 10^{-4}$ mols and $1.1 \times 10^{-4}$ mols per mol of a silver halide for large- and small-size emulsions, respectively)

In addition, a compound below was added in an amount of $2.6 \times 10^{-3}$ mols per mol of a silver halide.

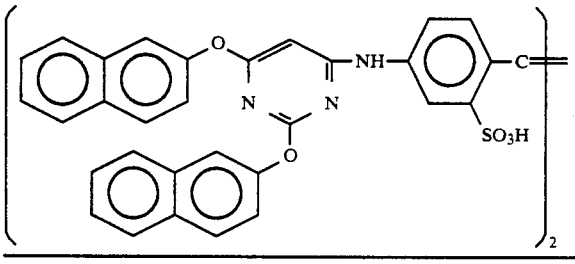

1-(5-methylureidophenyl)-5-mercaptotetrazole was added to the blue-, green-, and red-sensitive emulsion layers in amounts of $8.5 \times 10^{-5}$ mol, $7.7 \times 10^{-4}$ mol, and $2.5 \times 10^{-4}$ mol per mol of the silver halide, respectively.

4-hydroxy-6-methyl-1,3,3a,7-tetrazaindene was added in amount of $1 \times 10^{-4}$ mol and $2 \times 10^{-4}$ mol per mol of the silver halide, respectively, to each of the blue- and green-sensitive emulsion layers.

In addition, the following dyes (coating amounts are represented in the parentheses) were added to the emulsion layers for anti-irradiation.

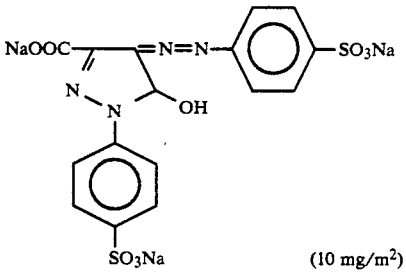

(10 mg/m²)

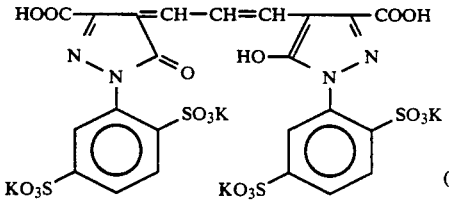

(10 mg/m²)

-continued

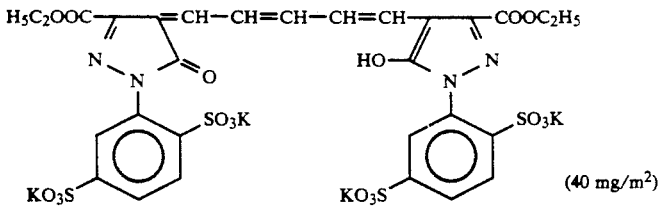

(40 mg/m²)

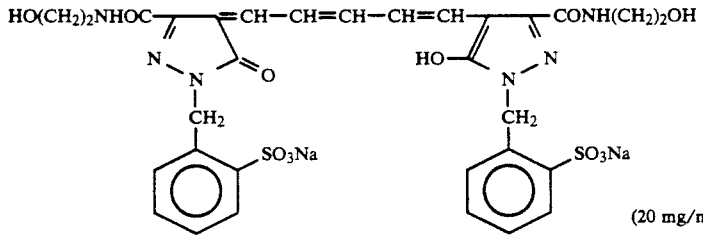

(20 mg/m²)

Layer arrangement

Tables 14 to 17 show compositions of the respective layers. Numbers represent coating amounts (g/m²). A coating amount of each silver halide emulsion is represented by the coating amount of silver.

TABLE 14

| | |
|---|---|
| Support | |
| Polyethylene-laminated paper (containing a white pigment ($TiO_2$) and a blue dye (ultramarine blue) in polyethylene on the first layer side) | |
| First layer (blue-sensitive emulsion layer) | |
| Silver chlorobromide emulsion (Cubic, a 3:7 mixture (molar ratio of silver) of a large-size emulsion having an average grain size of 0.88 μm and a small-size emulsion having that of 0.70 μm. Variation coefficients in grain size distributions of the two emulsions are 0.08 and 0.10, respectively. Each emulsion locally contained 0.3 mol % of silver bromide in a portion of the surface of each grain.) | 0.20 |
| Gelatin | 1.44 |
| Yellow coupler (ExY) | 0.48 |
| Dye image stabilizer (Cpd-1) | 0.15 |
| Solvent (Solv-3) | 0.12 |
| Solvent (Solv-7) | 0.12 |
| Dye image estabilizer (Cpd-7) | 0.04 |
| Dye image stabilizer (Cpd-9) | 0.03 |
| Stabilizer (Cpd-12) | 0.01 |

TABLE 15

| | |
|---|---|
| Second layer (color mixing inhibiting layer) | |
| Gelatin | 0.99 |
| Dye stabilizer (Cpd-1) | 0.08 |
| Solvent (Solv-1) | 0.16 |
| Solvent (Solv-4) | 0.08 |
| Third layer (green-sensitive emulsion layer) | |
| Silver chlorobromide emulsion (Cubic, a 1:3 (molar ratio of Ag) mixture of large-size emulsion having an average grain size of 0.55 μm and a small-size emulsion having that of 0.39 μm. Variation coefficients in grain size distributions of the two emulsions are 0.10 and 0.08, respectively. Each emulsion locally contained 0.8 mol % of AgBr in a portion of the surface of each grain.) | 0.12 |
| Gelatin | 1.24 |

TABLE 15-continued

| | |
|---|---|
| Magenta coupler (ExM) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |

TABLE 16

| | |
|---|---|
| Fourth layer (Ultraviolet absorbing layer) | |
| Gelatin | 1.58 |
| Ultraviolet absorbent (UV-1) | 0.47 |
| Color mixing inhibitor (Cpd-5) | 0.05 |
| Solvent (Solv-5) | 0.24 |
| Fifth layer (red-sensitive emulsion layer) | |
| Silver chlorobromide emulsion (Cubic, a 1:4 (molar ratio of Ag) mixture of large-size emulsion having an average grain size of 0.58 μm and a small-size emulsion having that of 0.45 μm. Variation coefficients in grain size distributions of the two emulsions are 0.09 and 0.11, respectively. Each emulsion locally contained 0.6 mol % of AgBr in a portion of the surface of each grain.) | 0.23 |
| Gelatin | 1.34 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-7) | 0.40 |
| Dye image stabilizer (Cpd-8) | 0.05 |
| Solvent (Solv-6) | 0.14 |

TABLE 17

| | |
|---|---|
| Sixth layer (ultraviolet absorbing layer) | |
| Gelatin | 1.53 |
| Ultraviolet absorbent (UV-1) | 0.16 |
| Color mixing inhibitor (Cpd-5) | 0.02 |
| Solvent (Solv-5) | 0.08 |
| Seventh layer (protective layer) | |
| Gelatin | 1.33 |
| Acryl-modified copolymer of polyvinyl alcohol (modification degree: 17%) | 0.17 |
| Liquid paraffin | 0.03 |

Various additives herein used are represented by below.

(ExY) Yellow coupler

-continued
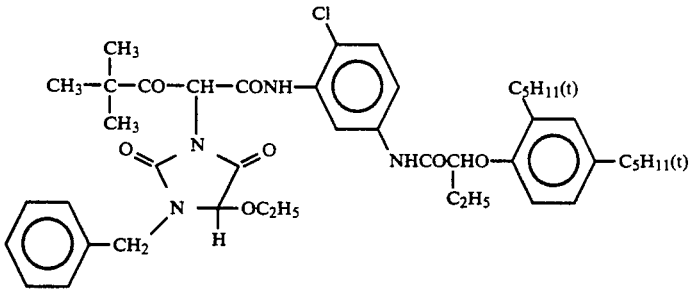
(ExM) Magenta coupler
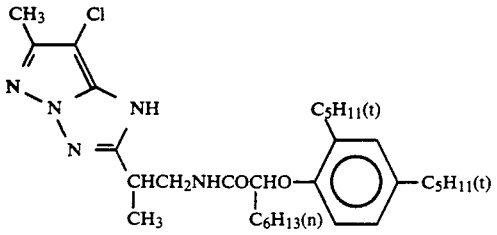
(ExC) Cyan coupler
A mixture (in molar ratio of 1:1) of:
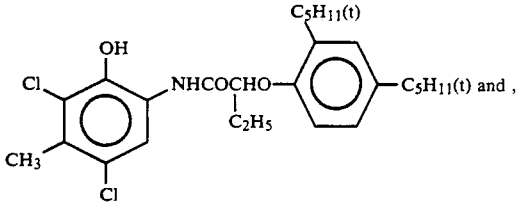
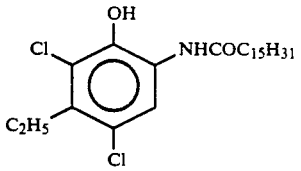
(Cpd-1) Dye image stabilizer
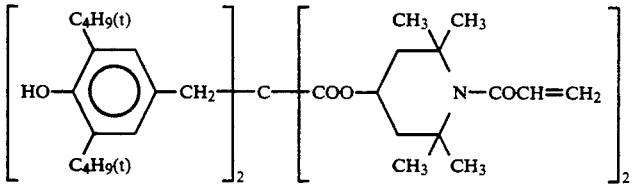
(Cpd-2) Dye image stabilizer
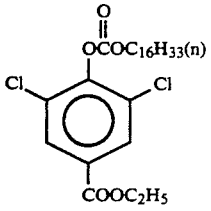
(Cpd-3) Dye image stabilizer -continued
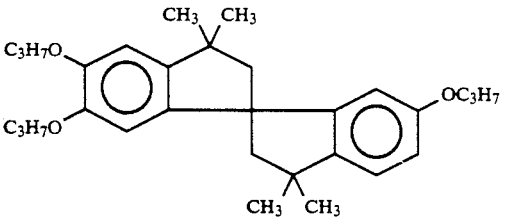
(Cpd-4) Dye image stabilizer
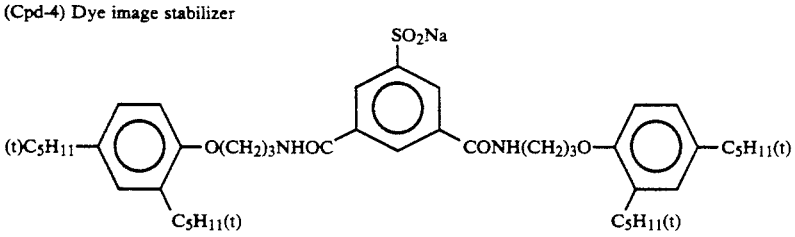
(Cpd-5) Color mixing inhibitor
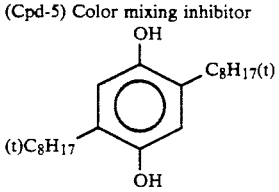
(Cpd-6) Dye image stabilizer
A mixture (weight mixing ratio 2:4:4:) of:
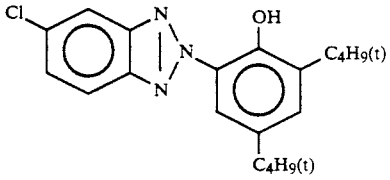
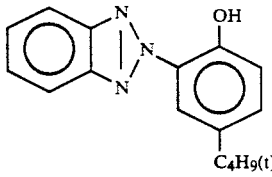
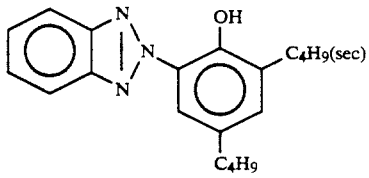
and,
(Cpd-7) Dye image stabilizer
$$\left(CH_2-\underset{\substack{|\\ CONHC_4H_9(t)}}{CH}\right)_n$$
mean molecular weight about 60,0000
(Cpd-8) Dye image stabilizer
A mixture (weight mixing ratio 1:1) of:
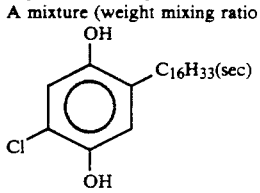
and
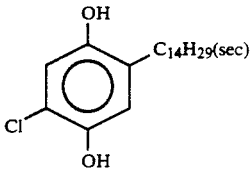

-continued
(Cpd-9) Dye image stabilizer
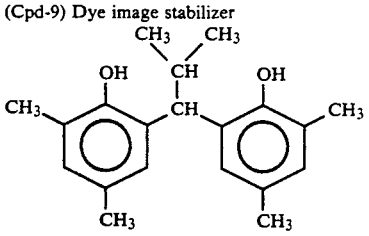
(Cpd-10) Antiseptic
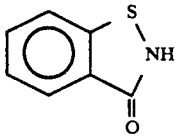
(Cpd-11) Antiseptic
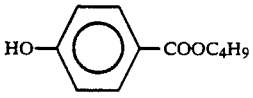
(Cpd-12) Stabilizer
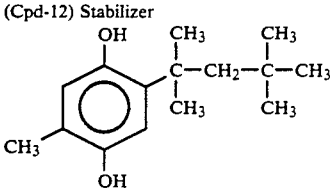
(UV-1) Ultraviolet absorbent
A mixture (weight mixing ratio 4:2:4) of:
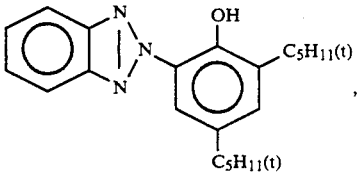
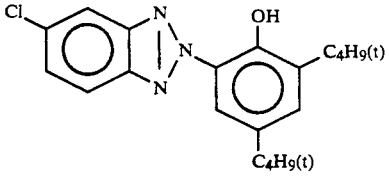
and,
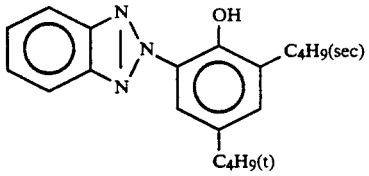
(H-1)
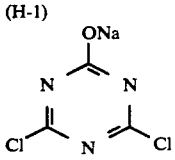
(H-2)
$CH_2{=}CH{-}SO_2{-}CH_2{-}CONH{-}CH_2$
$\quad\quad\quad -continued (Solv-1) Solvent

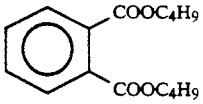

(Solv-2) Solvent
A mixture (volume mixing ratio of 1:1) of:

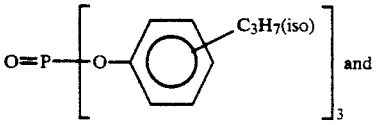

and

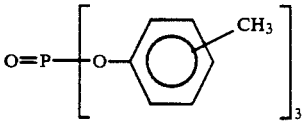

(Solv-3) Solvent
$O{=}P{+}O{-}C_9H_{19}(iso)]_3$ (Solv-4) Solvent

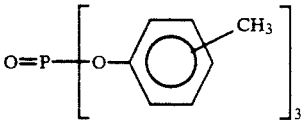

(Solv-5) Solvent $$\begin{array}{l} COOC_8H_{17} \\ | \\ (CH_2)_8 \\ | \\ COOC_8H_{17} \end{array}$$

(Solv-6) Solvent
A mixture (volume mixing ratio of 80:20) of:

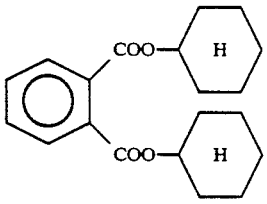

and $$C_8H_{17}\underset{\diagdown\,O\,\diagup}{CHCH}(CH_2)_7COOC_8H_{17}$$

(Solv-7) Solvent $$C_8H_{17}\underset{\diagdown\,O\,\diagup}{CHCH}(CH_2)_7COOC_8H_{17}$$

The sample 1 was subjected to sensitometry as follows. First, a sensitometer (FWH type available from Fuji Photo Film. Co. Ltd., color temperature of light source=3,200K) was used to apply gradation exposure through a sensitometry separation filter to each sample. The exposure in this case was performed with an exposure amount of 250 CMS for an exposure time of 0.1 sec.

By using a paper processor, the exposed sample 1 was subjected to a continuous processing (running test) in accordance with processing steps and using processing solutions having compositions, shown in Tables 18 to 20, until the quantity of a replenisher became twice the tank volume of color development.

TABLE 18

| Processing step | Temperature | Time | Quantity* of replenisher | Tank volume |
|---|---|---|---|---|
| Color development | 35° C. | 45 sec. | 161 ml | 17 l |
| Bleach-fixing | 35° C. | 45 sec. | 215 ml | 17 l |
| Rinsing 1 | 35° C. | 20 sec. | — | 10 l |
| Rinsing 2 | 35° C. | 20 sec. | — | 10 l |
| Rinsing 3 | 35° C. | 20 sec. | 360 ml | 10 l |
| Drying | 80° C. | 60 sec. | | |

(*A quantity of a replenisher per $m^2$ of a light-sensitive material)
(3-tank counter flow piping from rinsing 3 to 1)

TABLE 19

| Color developing solution | Tank solution | Replenisher |
|---|---|---|
| Water | 700 ml | 700 ml |
| Ethylenediaminetetraacetic acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium chloride | 1.6 g | — |
| Potassium chloride | 0.01 g | — |
| Potassium carbonate | 27.0 g | 27.0 g |
| Fluorescent brightener (WHITBX 4B available from SUMITOMO CHEMICAL CO., LTD.) | 1.0 g | 2.5 g |
| Sodium sulfite | 0.1 g | 0.2 g |
| Disodium-N,N-bis(sulfonateethyl) hydroxylamine | 8.0 g | 10.0 g |
| N-ethyl-N-(β-methanesulfonamido ethyl)-3-methyl-aminoaniline sulfate | 5.0 g | 7.1 g |
| Water to make | 1,000 ml | 1,000 ml |
| pH (25° C.) | 10.05 | 10.45 |

TABLE 20

| Bleach-fixing solution | (A tank solution and a replenisher are the same) |
|---|---|
| Water | 600 ml |
| Ammonium thiosulfate (700 g/l) | 100 ml |
| Iron(III) sodium ethylenediamine tetraacetate | 55 g |
| Ethylenediaminetetraacetic acid | 5 g |
| Ammonium bromide | 40 g |
| Nitric acid (67%) | 30 g |
| Water to make | 1,000 ml |
| pH (25° C.) (adjusted by acetic acid or ammonia water) | 5.8 |

| Rinsing solution | (A tank solution and a replenisher are the same) |
|---|---|
| Ion exchange water (each of calcium and magnesium is 3 ppm or less) | |

In addition, samples were prepared by replacing the yellow coupler (ExY) of the blue-sensitive emulsion layer with equal molar quantities of the comparative couplers in Example 1 and the couplers of the present invention. The same evaluation as for the sample 1 were performed for these samples.

In this case, almost the same effects as in Example 1 were also obtained.

EXAMPLE 4

Layers having the following compositions were coated on a subbed cellulose triacetate support to prepare a sample 101 as a multilayered color light-sensitive material.

Compositions of light-sensitive layers

Values corresponding to the respective components represent their coating amounts in units of g/m$^2$. The coating amount of each silver halide is represented by the content of silver. Note that a value given to each sensitizing dye represents its coating amount in units of mols per mol of a silver halide in the same layer.

| (Sample 101) | | |
|---|---|---|
| First layer (Antihalation layer) | | |
| Black colloidal silver | silver | 0.18 |
| Gelatin | | 1.40 |
| Second layer (Interlayer) | | |
| 2,5-di-t-pentadecylhydroquinone | | 0.18 |
| EX-1 | | 0.18 |
| EX-3 | | 0.20 |
| EX-12 | | $2.0 \times 10^{-3}$ |
| U-1 | | 0.060 |
| U-2 | | 0.080 |
| U-3 | | 0.10 |
| HBS-1 | | 0.10 |
| HBS-2 | | 0.020 |
| Gelatin | | 1.04 |
| Third layer (1st red-sensitive emulsion layer) | | |
| Emulsion A | silver | 0.25 |
| Emulsion B | silver | 0.25 |
| Sensitizing dye I | | $6.9 \times 10^{-5}$ |
| Sensitizing dye II | | $1.8 \times 10^{-5}$ |
| Sensitizing dye III | | $3.1 \times 10^{-4}$ |
| EX-2 | | 0.17 |
| EX-10 | | 0.020 |
| EX-14 | | 0.17 |
| U-1 | | 0.070 |
| U-2 | | 0.050 |
| U-3 | | 0.070 |
| HBS-1 | | 0.060 |
| Gelatin | | 0.87 |
| Fourth Layer (2nd red-sensitive emulsion layer) | | |
| Emulsion G | silver | 1.00 |
| Sensitizing dye I | | $5.1 \times 10^{-5}$ |
| Sensitizing dye II | | $1.4 \times 10^{-5}$ |
| Sensitizing dye III | | $2.3 \times 10^{-4}$ |
| EX-2 | | 0.20 |
| EX-3 | | 0.050 |
| EX-10 | | 0.015 |
| EX-14 | | 0.20 |
| EX-15 | | 0.050 |
| U-1 | | 0.070 |
| U-2 | | 0.050 |
| U-3 | | 0.070 |
| Gelatin | | 1.30 |
| Fifth layer (3rd red-sensitive emulsion layer) | | |
| Emulsion D | silver | 1.60 |
| Sensitizing dye I | | $5.4 \times 10^{-5}$ |
| Sensitizing dye II | | $1.4 \times 10^{-5}$ |
| Sensitizing dye III | | $2.4 \times 10^{-4}$ |
| EX-2 | | 0.097 |
| EX-3 | | 0.010 |
| EX-4 | | 0.080 |
| HBS-1 | | 0.22 |
| HBS-2 | | 0.10 |
| Gelatin | | 1.63 |
| Sixth layer (Interlayer) | | |
| EX-5 | | 0.040 |
| HBS-1 | | 0.020 |
| Gelatin | | 0.80 |
| Seventh layer (1st green-sensitive emulsion layer) | | |
| Emulsion A | silver | 0.15 |
| Emulsion B | silver | 0.15 |
| Sensitizing dye IV | | $3.0 \times 10^{-5}$ |
| Sensitizing dye V | | $1.0 \times 10^{-4}$ |
| Sensitizing dye VI | | $3.8 \times 10^{-4}$ |
| EX-1 | | 0.021 |
| EX-6 | | 0.26 |
| EX-7 | | 0.030 |
| EX-8 | | 0.025 |
| HBS-1 | | 0.10 |
| HBS-3 | | 0.010 |
| Gelatin | | 0.63 |
| Eighth layer (2nd green-sensitive emulsion layer) | | |
| Emulsion C | silver | 0.45 |
| Sensitizing dye IV | | $2.1 \times 10^{-5}$ |
| Sensitizing dye V | | $7.0 \times 10^{-5}$ |
| Sensitizing dye VI | | $2.6 \times 10^{-4}$ |
| EX-6 | | 0.094 |
| EX-7 | | 0.026 |
| EX-8 | | 0.018 |
| HBS-1 | | 0.16 |
| HBS-3 | | $8.0 \times 10^{-3}$ |
| Gelatin | | 0.50 |
| Ninth layer (3rd green-sensitive emulsion layer) | | |
| Emulsion E | silver | 1.20 |

-continued (Sample 101)

| | | |
|---|---|---|
| Sensitizing dye IV | | $3.5 \times 10^{-5}$ |
| Sensitizing dye V | | $8.0 \times 10^{-5}$ |
| Sensitizing dye VI | | $3.0 \times 10^{-4}$ |
| EX-1 | | 0.013 |
| EX-11 | | 0.065 |
| EX-13 | | 0.019 |
| HBS-1 | | 0.25 |
| HBS-2 | | 0.10 |
| Gelatin | | 1.54 |
| Tenth layer (Yellow filter layer) | | |
| Yellow colloidal silver | silver | 0.050 |
| EX-5 | | 0.080 |
| HBS-1 | | 0.030 |
| Gelatin | | 0.95 |
| Eleventh layer (1st blue-sensitive emulsion layer) | | |
| Emulsion A | silver | 0.080 |
| Emulsion B | silver | 0.070 |
| Emulsion F | silver | 0.070 |
| Sensitizing dye VII | | $3.5 \times 10^{-4}$ |
| EX-8 | | 0.042 |
| EX-9 | | 0.72 |
| HBS-1 | | 0.28 |
| Gelatin | | 1.10 |
| Twelfth layer (2nd blue-sensitive emulsion layer) | | |
| Emulsion G | silver | 0.45 |
| Sensitizing dye VII | | $2.1 \times 10^{-4}$ |
| EX-9 | | 0.15 |
| EX-10 | | $7.0 \times 10^{-3}$ |
| HBS-1 | | 0.050 |
| Gelatin | | 0.78 |
| Thirteenth layer (3rd blue-sensitive emulsion layer) | | |

-continued (Sample 101)

| | | |
|---|---|---|
| Emulsion H | silver | 0.77 |
| Sensitizing dye VII | | $2.2 \times 10^{-4}$ |
| EX-9 | | 0.20 |
| HBS-1 | | 0.070 |
| Gelatin | | 0.69 |
| Fourteenth layer (1st protective layer) | | |
| Emulsion I | silver | 0.20 |
| U-4 | | 0.11 |
| U-5 | | 0.17 |
| HBS-1 | | $5.0 \times 10^{-2}$ |
| Gelatin | | 1.00 |
| Fifteenth layer (2nd protective layer) | | |
| H-1 | | 0.40 |
| B-1 (diameter = 1.7 μm) | | $5.0 \times 10^{-2}$ |
| B-2 (diameter = 1.7 μm) | | 0.10 |
| B-3 | | 0.10 |
| S-1 | | 0.20 |
| Gelatin | | 1.20 |

In addition, in order to improve storage stability, processability, a resistance to pressure, antiseptic and mildewproofing properties, antistatic properties, and coating properties, W-1, W-2, W-3, B-4, B-5, F-1, F-2, F-3, F-4, F-5, F-6, F-7, F-8, F-9, F-10, F-11, F-12, F-13, F-14, F-15, F-16, F-17, and an iron salt, lead salt, gold salt, platinum salt, iridium salt, and rhodium salt were added to all of the above layers. Emulsions A to I and various additives used in this example are shown in Table 21 and below.

TABLE 21

| | Average AgI content (%) | Average grain size (μm) | Variation coefficient (%) according to grain size | Diameter/ thickness ratio | Silver amount ratio (AgI content, %) |
|---|---|---|---|---|---|
| Emulsion A | 4.0 | 0.45 | 27 | 1 | Core/shell = 1/3(13/1), Double structure grain |
| Emulsion B | 8.9 | 0.70 | 14 | 1 | Core/shell = 3/7(25/2), Double structure grain |
| Emulsion C | 10 | 0.75 | 30 | 2 | Core/shell = 1/2(24/3), Double structure grain |
| Emulsion D | 16 | 1.05 | 35 | 2 | Core/shell = 4/6(40/0), Double structure grain |
| Emulsion E | 10 | 1.05 | 35 | 3 | Core/shell = 1/2(24/3), Double structure grain |
| Emulsion F | 4.0 | 0.25 | 28 | 1 | Core/shell = 1/3(13/1), Double structure grain |
| Emulsion G | 14.0 | 0.75 | 25 | 2 | Core/shell = 1/2(42/0), Double structure grain |
| Emulsion H | 14.5 | 1.30 | 25 | 3 | Core/shell = 37/63(34/3), Double structure grain |
| Emulsion I | 1 | 0.07 | 15 | 1 | Uniform grain |

EX-1

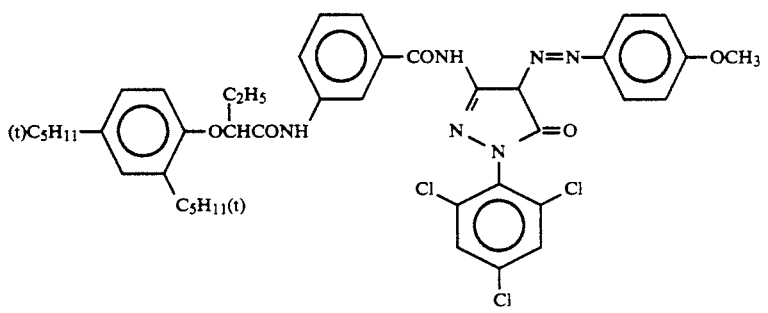

-continued
EX-2
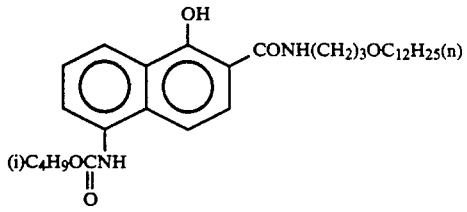
EX-3
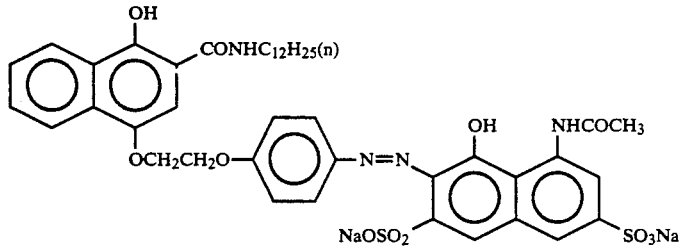
EX-4
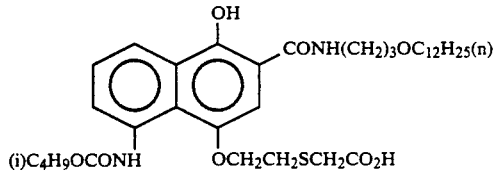
EX-5
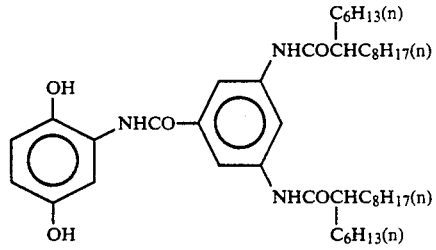
EX-6
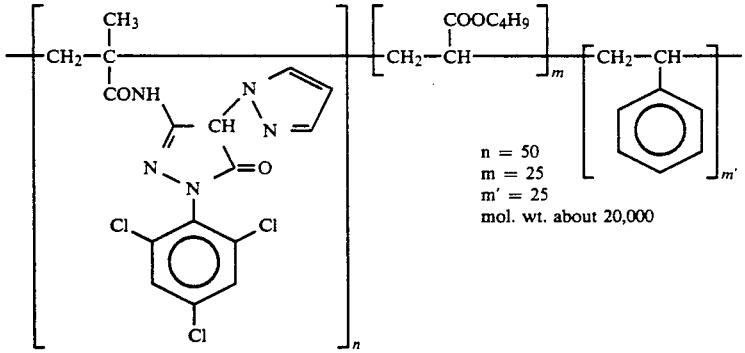
EX-7
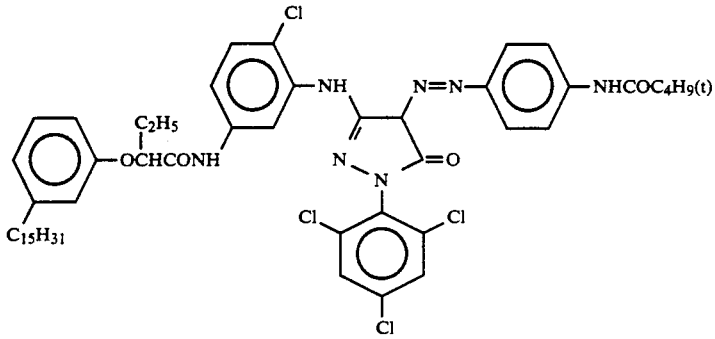

-continued
EX-8
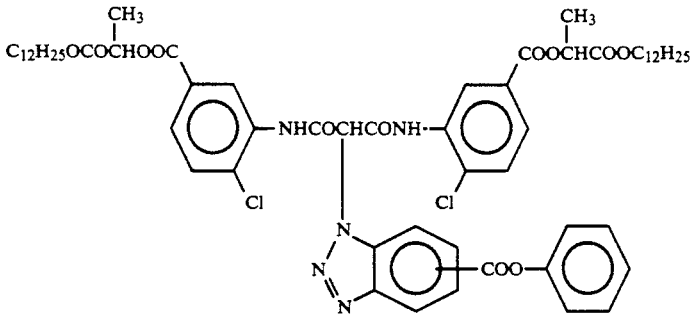
EX-9
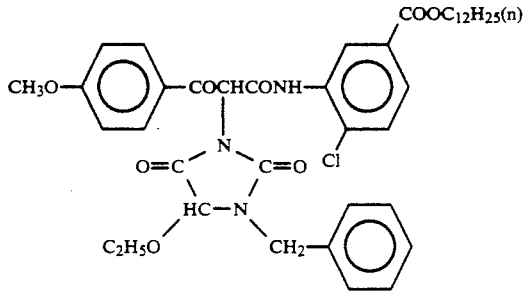
EX-10
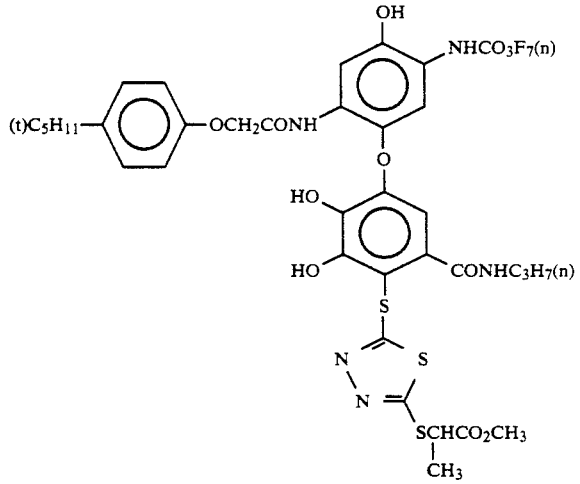
EX-11
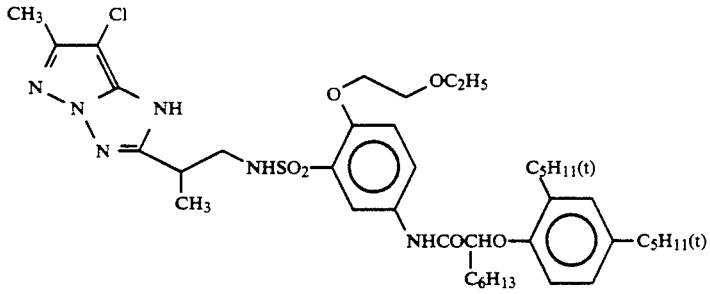
EX-12
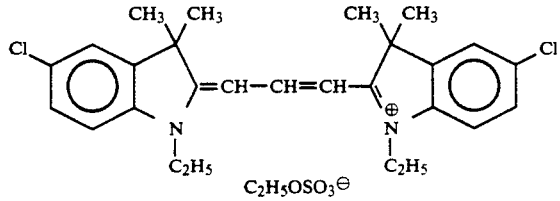

-continued
EX-13
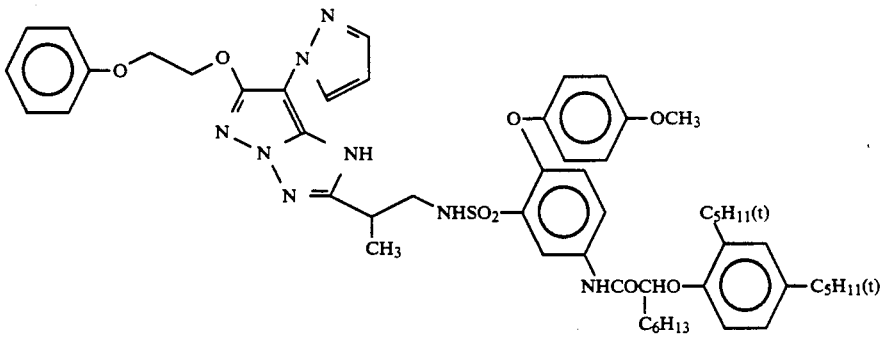
EX-14
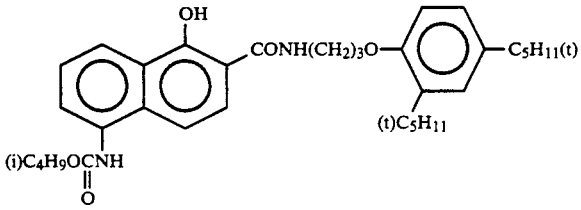
EX-15
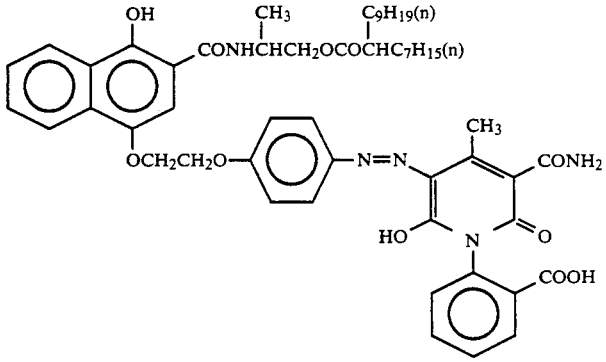
-continued
U-1
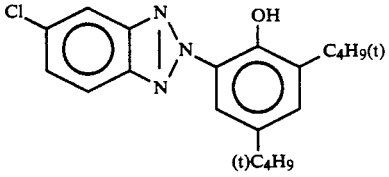
U-2
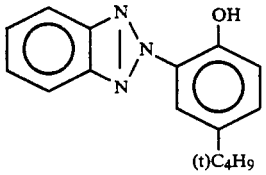
U-3
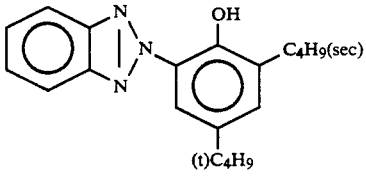
U-4
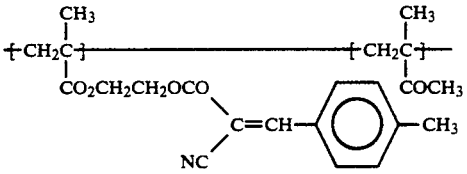
x:y = 70:30 (wt%)
U-5
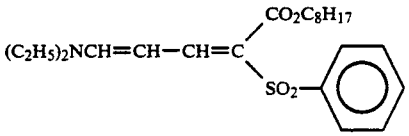

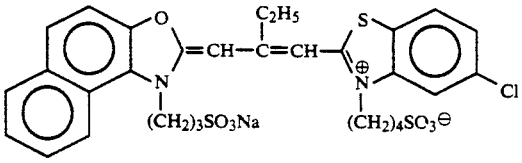
Sensitizing dye I
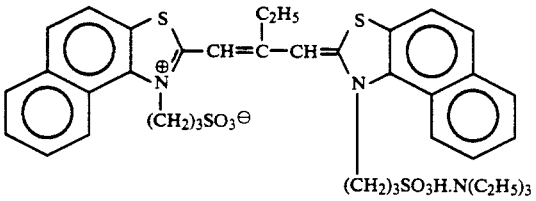
Sensitizing dye II
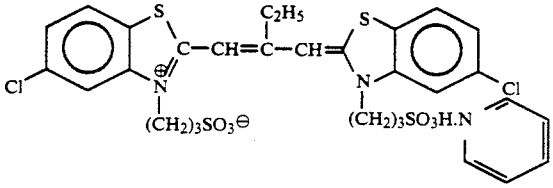
Sensitizing dye III
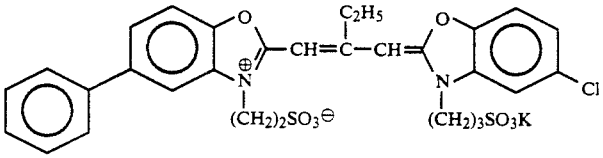
Sensitizing dye IV
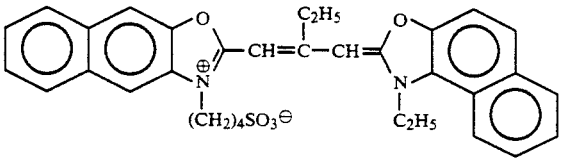
Sensitizing dye V
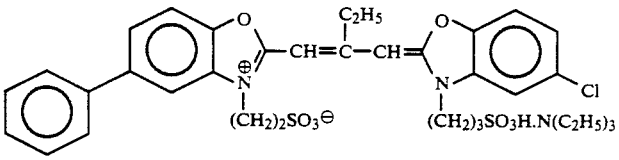
Sensitizing dye VI
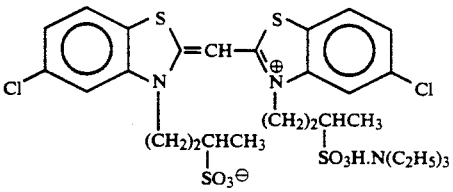
Sensitizing dye VII
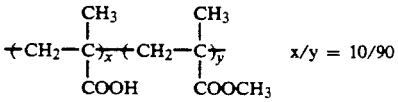
B-1 x/y = 10/90
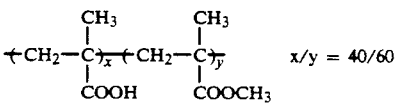
B-2 x/y = 40/60
-continued
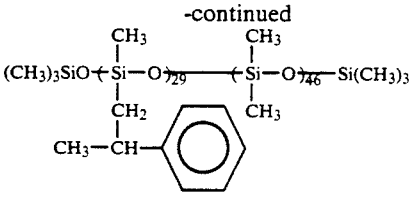
B-3

-continued
B-4
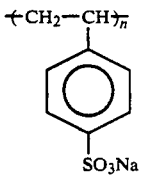
B-5
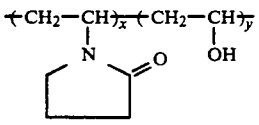
x/y = 70/30
F-1
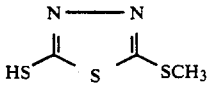
F-2
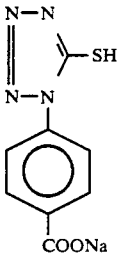
F-3
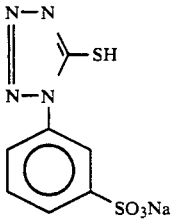
F-4
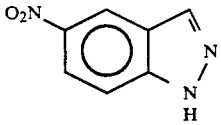
F-5
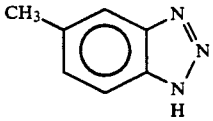
F-6
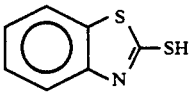
F-7
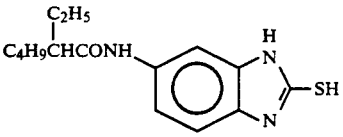
-continued
F-8
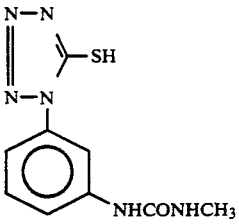
F-9
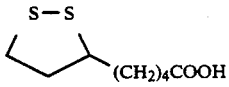
F-10
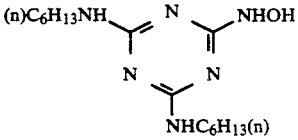
F-11
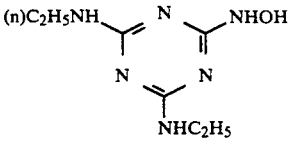
F-12
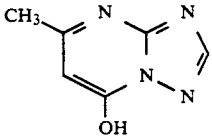
F-13
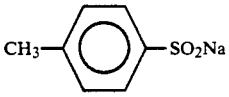
F-14
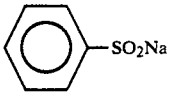
F-15
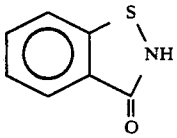
F-16
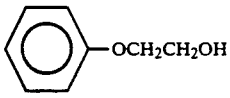
F-17
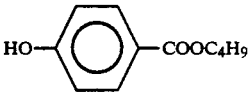
W-1
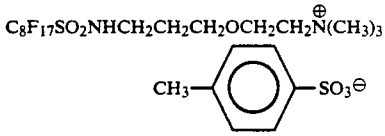

-continued

W-2

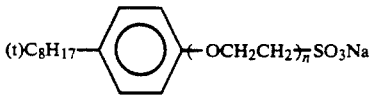

n = 2 to 4

W-3

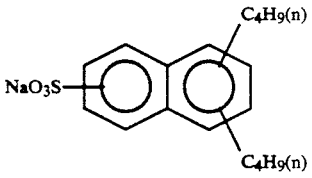

Samples were prepared by replacing the yellow coupler EX-9 in each of the eleventh, twelfth, and thirteenth layers of the sample 101 with equal molar quantities of the couplers of the present invention described in Example 2.

A sensitometer (FWH type available from Fuji Photo Film. Co. Ltd., color temperature of light source=4,800K) was used to apply gradation exposure for sensitometry to each of these samples. The exposure in this case was performed with an exposure amount of 20 CMS for an exposure time of 0.01 sec.

By using a negative automatic developing machine, the exposed samples were subjected to a continuous processing (running test) in accordance with processing steps shown in Tables 22 to 26 by using processing solutions having compositions shown in these tables, until the quantity of a replenisher became three times the tank volume of color development.

TABLE 22

| Processing step | Temperature | Time | Quantity* of replenisher | Tank volume |
|---|---|---|---|---|
| Color development | 38°C. | 3 min. 15 sec. | 45 ml | 10 l |
| Bleaching | 38° C. | 1 min. 00 sec. | 20 ml | 4 l |
| Bleach-fixing | 38° C. | 3 min. 15 sec. | 30 ml | 8 l |
| Washing (1) | 35° C. | 40 sec. | Counter flow piping from (2) to (1) | 4 l |
| Washing (2) | 35° C. | 1 min. 00 sec. | 30 ml | 4 l |
| Stabilization | 38° C. | 40 sec. | 20 ml | 4 l |
| Drying | 55° C. | | | |

(*A quantity of a replenisher per meter of a 35-mm wide sample)

TABLE 23

| Color developing solution | Mother solution | Replenisher |
|---|---|---|
| Water | 700 ml | 700 ml |
| Diethylenetriaminepentaacetic acid | 1.0 g | 1.1 g |
| 1-hydroxyethylidene-1,1-diphosphonic acid | 3.0 g | 3.2 g |
| Sodium sulfite | 4.0 g | 4.4 g |
| Potassium carbonate | 30.0 g | 37.0 g |
| Potassium bromide | 1.4 g | 0.7 g |
| Potassium iodide | 1.5 mg | — |
| Hydroxylaminesulfate | 2.4 g | 2.8 g |
| 4-(N-ethyl-N-(β-hydroxyethylamino)-2-methylanilinesulfate | 4.5 g | 5.5 g |
| Water to make | 1,000 ml | 1,000 ml |
| pH (25° C.) | 10.05 | 10.10 |

TABLE 24

| Bleaching solution (Common for a mother solution and a replenisher) | |
|---|---|
| Water | 700.0 ml |
| Iron(III) sodium ethylenediamine tetraacetate dihydrate | 120.0 g |
| Disodium ethylenediaminetetraacetate | 10.0 g |
| Ammonium bromide | 100.0 g |
| Ammonium nitrate | 10.0 g |
| Bis(N,N-dimethylamynoethyl)sulfide hydrochloride | 1.4 g |
| Ammonia water (27%) | 15.0 ml |
| Water to make | 1000.0 ml |
| pH (25° C.) | 6.3 |

TABLE 25

| Bleach-fixing solution (Common for a mother solution and a replenisher) | |
|---|---|
| Water | 700.0 ml |
| Iron(III) sodium ethylenediamine tetraacetate dihydrate | 50.0 g |
| Disodium ethylenediaminetetraacetate | 5.0 g |
| Sodium sulfite | 12.0 g |
| Ammonium thiosulfate (70% aqueous solution) | 240.0 ml |
| Ammonia water (27%) | 6.0 ml |
| Water to make | 1,000.0 ml |
| pH (25° C.) | 7.2 |

TABLE 26

| Washing solution (Common for a mother solution and a replenisher) | |
|---|---|
| Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium dichloroisocyanurate and 0.15 g/l of sodium sulfate were added. The pH of the solution fell within the range of 6.5 to 7.5. | |
| **Stabilizing solution (Common for a mother solution and a replenisher)** | |
| Formalin (37%) | 2.0 ml |
| Polyoxyethylene-p-monononylphenylether (average polymerization degree = 10) | 0.3 g |
| Disodium ethylenediaminetetraacetate | 0.05 g |
| Water to make | 1,000.0 ml |
| pH (25° C.) | 5.0–8.0 |

The color forming properties were evaluated by comparing color densities with reference to the fog densities of the respective samples at an exposure amount for yielding a color density which was 1.5 times the fog density of the sample 101.

The dye fastnesses of the samples were evaluated by decreases in dye image densities with respect to an initial density of 1.5 (with reference to the fog density) after the samples were stored at a temperature of 60° C. and a humidity of 70% RH for 14 days.

Also in this evaluation, the results almost the same as in Example 2 were obtained.

What is claimed is:

1. A silver halide color photographic light-sensitive material containing at least one of bicylo[m.n.0]alkane-1-ylcarbonylacetamide-based yellow dye-forming coupler wherein m represents an integer of 2 to 5, n represents an integer of 1 to 3, the sum of m and n is an integer of 3 to 7, and 0 represents zero.

2. The silver halide color photographic light-sensitive material according to claim 1, wherein the at least one yellow dye-forming coupler is represented by the Formula (1) below:

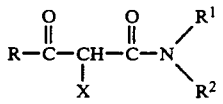

wherein in Formula (1), R represents a bicyclo[m.n.0]alkane-1-yl group, m represents an integer of 2 to 5, n represents an integer of 1 to 3, the sum of m and n is an integer of 3 to 7, 0 represents zero, $R^1$ and $R^2$ independently represent a hydrogen atom, an alkyl group, an aryl group or a heterocyclic group, and X represents a hydrogen atom or a group which can split off upon a coupling reaction with the oxidized form of an aromatic primary amine developing agent.

3. The silver halide color photographic light-sensitive material according to claim 2, wherein the yellow dye-forming coupler is represented by the Formula (2) below:

Formula (2)

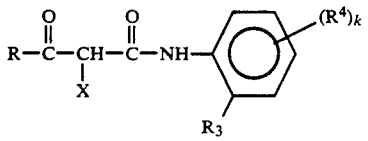

wherein in Formula (2), R and X are the same as those of Formula (1), $R^3$ represents a hydrogen atom, a halogen atom, an alkoxy group, an aryloxy group, an alkyl group, or an amino group including mono- and di-substituted amino groups, $R^4$ represents a group substitutable on a benzene ring, and k represents an integer of 0 to 4.

4. The silver halide color photographic light-sensitive material according to claim 3, wherein the bicylo[m.n.0]alkane-1-yl group represented by R in Formula (2) are bicyclo[2.1.0]pentane-1-yl, bicyclo[2.2.0]hexane-1-yl, bicyclo[3.1.0]hexane-1-yl, bicyclo[3.2.0]heptane-1-yl, bicyclo[3.3.0]octane-1-yl, bicyclo[4.1.0]heptane-1-yl, bicyclo[4.2.0]octane-1-yl, bicyclo[4.3.0]nonane-1-yl, bicyclo[5.1.0]octane-1-yl, or bicyclo[5.2.0]nonane-1-yl.

5. The silver halide color photographic light-sensitive material according to claim 3, wherein R in Formula (2) is represented by the following Formula (3), (4), (5), (6) or (7):

Formula (3)

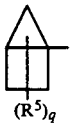

Formula (4)

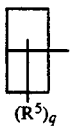

Formula (5)

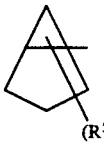

-continued

Formula (6)

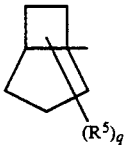

Formula (7)

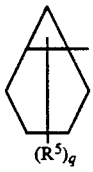

wherein in formulas (3) to (7), $R^5$ represents a group substitutable to bicycloalkane, and g represents an integer of 0 to 5, if q represents the plural number, a plurality of $R^5$'s may be the same or different.

6. The silver halide color photographic light sensitive material according to claim 5, wherein formulas (3)–(7) have 5–36, 6–36, 6–36, 7–36 and 7–36 carbon atoms, respectively.

7. The silver halide color photographic light sensitive material according to claim 5, wherein $R^5$ is selected from the group consisting of halogen, cyano, alkyl, aryl, alkoxy, aryloxy, alkylthio, arylthio, alkylsulfonyl, arylsulfonyl, acyl, alkoxycarbonyl, aryloxycarbonyl, carbonamido, sulfonamido, imido, heterocyclic, carbamoyl, sulfamoyl, alkoxycarbonylamino, sulfamoylamino, phosphono, ureido, carboxyl, sulfo and hydroxyl.

8. The silver halide color photographic light-sensitive material according to claim 3, wherein X in Formula (2) is a group represented by the following Formula (8) or (9):

Formula (8)

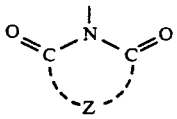

Formula (9)

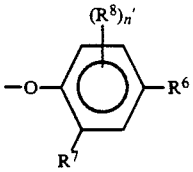

wherein in Formula (8), Z represents —O—$CR^9R^{10}$—, —S—$CR^9R^{10}$—, —$NR^{11}$—$CR^9R^{10}$—, —$NR^{11}$—$NR^{12}$—, —$NR^{11}$—CO—, —$CR^9R^{10}$—$CR^{13}R^{14}$—, or —$CR^{15}$=$CR^{16}$— wherein each of $R^9$, $R^{10}$, $R^{13}$, and $R^{14}$ represents hydrogen, alkyl, aryl, alkoxy, aryloxy, alkylthio, arylthio, alkylsulfonyl, arylsulfonyl, or amino, each of $R^{11}$ and $R^{12}$ represents hydrogen, alkyl, aryl, alkylsulfonyl, arylsulfonyl, or alkoxycarbonyl, and each of $R^{15}$ and $R^{16}$ represents hydrogen, alkyl, or aryl, wherein $R^{15}$ may combine with $R^{16}$ to form a benzene ring, and $R^9$ and $R^{10}$, $R^{10}$ and $R^{11}$, $R^{11}$ and $R^{12}$, or $R^9$ and $R^{13}$ may combine with each other to form a ring, and in Formula (9), at least one of $R^6$ and $R^7$ is a member selected from halogen, cyano, nitro, trifluoromethyl, carboxyl, alkoxycarbonyl, carbonamido, sulfonamido, carbamoyl, sulfamoyl, alkylsulfonyl, arylsulfonyl, and acyl, and the other may be hydrogen, an alkyl, or alkoxy, $R^8$ represents the same group as $R^6$ or $R^7$, and n represents an integer of 0 to 2.

9. The silver halide color photographic light sensitive material according to claim 3, wherein $R^3$ in formula (2) represents halogen, alkoxy having a carbon number of 1 to 30, aryloxy having a carbon number of 6 to 30, alkyl having a carbon number of 1 to 30, or amino having a carbon number of 0 to 30, each of which may be substituted, wherein the carbon number is defined as a total number of carbon atoms.

10. The silver halide color photographic light sensitive material according to claim 9, wherein $R^3$ represents chlorine, fluorine, alkyl having a carbon number of 1 to 6, alkoxy having a carbon number of 1 to 24, or aryloxy having a carbon number of 6 to 24.

11. The silver halide color photographic light sensitive material according to claim 10, wherein $R^3$ represents chlorine, methoxy, or trifluoromethyl.

12. The silver halide color photographic light sensitive material according to claim 3, wherein $R^4$ in formula (2) represents halogen, or alkyl having a carbon number of 1 to 30, aryl having a carbon number of 6 to 30, alkoxy having a carbon number of 1 to 30, alkoxycarbonyl having a carbon number of 2 to 30, aryloxycarbonyl having a carbon number of 7 to 30, carbonamido having a carbon number of 1 to 30, sulfonamido having a carbon number of 1 to 30, carbamoyl having a carbon number of 1 to 30, sulfamoyl having a carbon number of 0 to 30, alkylsulfonyl having a carbon number of 1 to 30, arylsulfonyl having a carbon number of 6 to 30, ureido having a carbon number of 1 to 30, sulfamoylamino having a carbon number of 0 to 30, alkoxycarbonylamino having a carbon number of 2 to 30, heterocyclic having a carbon number of 1 to 30, acyl having a carbon number of 1 to 30, alkysulfonyloxy having a carbon number of 1 to 30, or arylsulfonyloxy having a carbon number of 6 to 30, each of which may be substituted, wherein the carbon number is defined as a total number of carbon atoms.

13. The silver halide color photographic light sensitive material according to claim 12, wherein $R^4$ in formula (2) represents halogen, alkoxy, alkoxycarbonyl, aryloxycarbonyl, carbonamido, sulfonamido, carbamoyl, or sulfamoyl.

14. The silver halide color photographic light sensitive material according to claim 13, wherein $R^4$ represents alkoxy, alkoxycarbonyl, carbonamido, sulfamoyl, or sulfonamido.

15. The silver halide color photographic light sensitive material according to claim 3, wherein X in formula (2) represents a heterocyclic group which combines with a coupling active position by a nitrogen atom or an aryloxy group.

16. The silver halide color photographic light sensitive material according to claim 3, wherein R is selected from the group consisting of

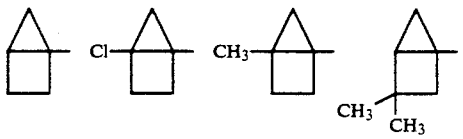

-continued

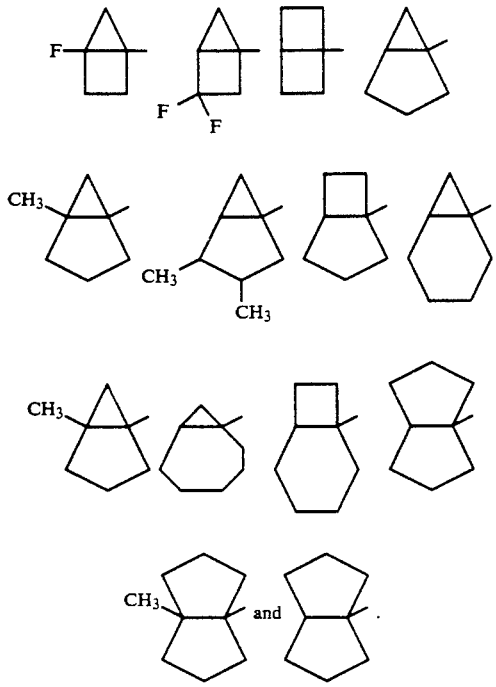

17. The silver halide color photographic light sensitive material according to claim 3, wherein $R^3$ is selected from the group consisting of

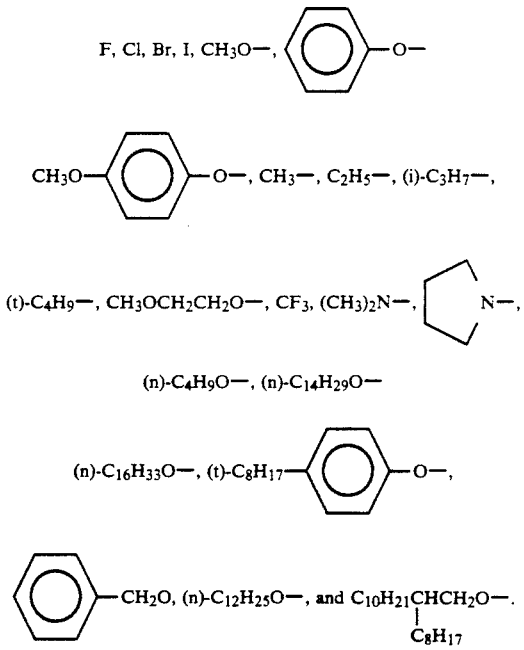

18. The silver halide color photographic light sensitive material according to claim 3, wherein $R^4$ is selected from the group consisting of

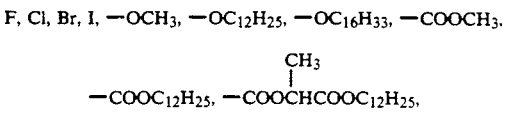

-continued
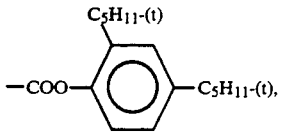
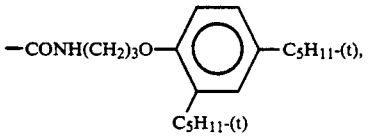
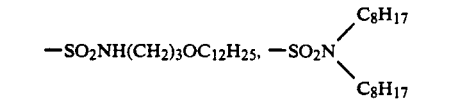
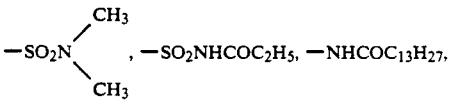
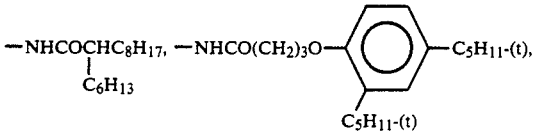
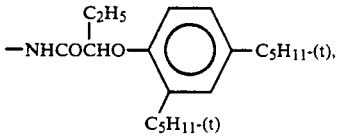
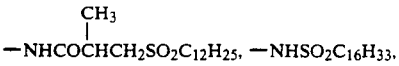
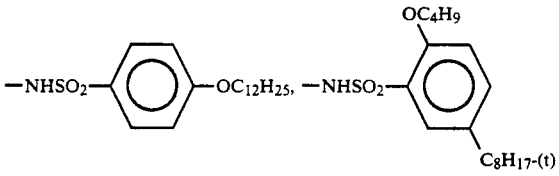
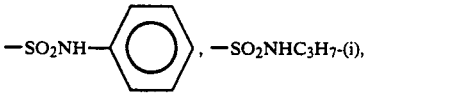
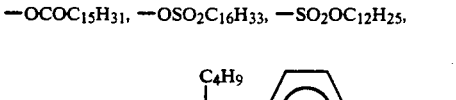
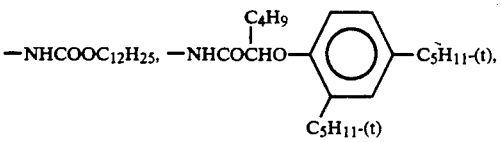
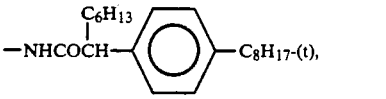
-continued
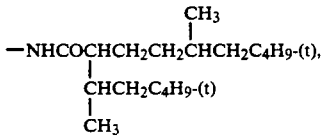
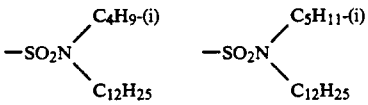
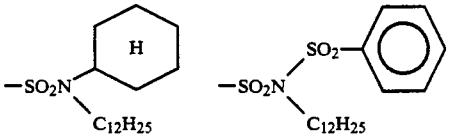
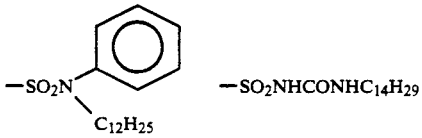
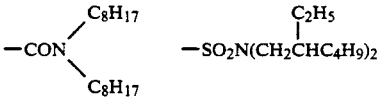
$-NHSO_2CH_3$ $-OCH_2COOC_{12}H_{25}$ $-CN$ $-NHSO_2C_4H_9$
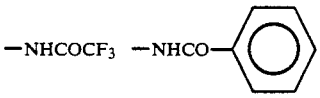
19. The silver halide color photographic light sensitive material according to claim 3, wherein X is selected from the group consisting of
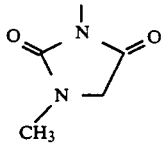
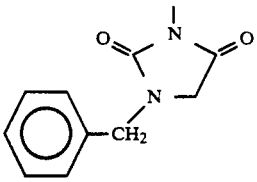
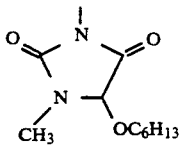
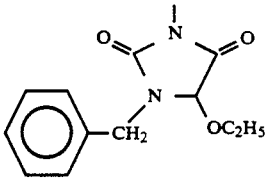
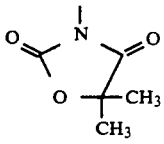
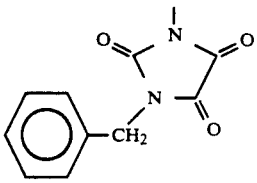

-continued
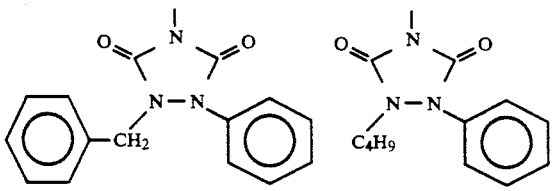
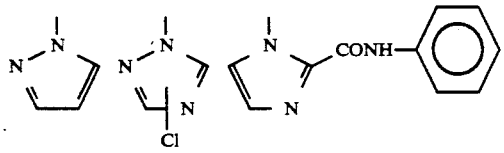
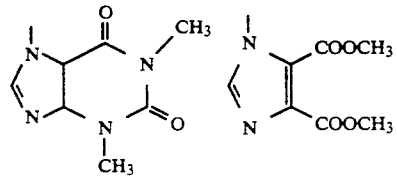
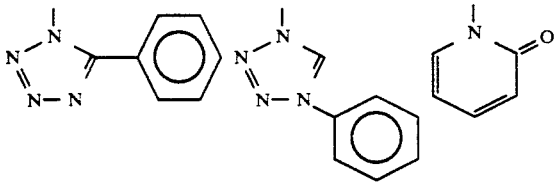
H Cl Br I —OCOCH$_3$ —OSO$_2$CH$_3$
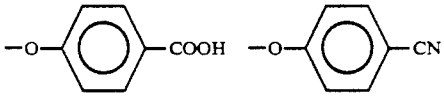
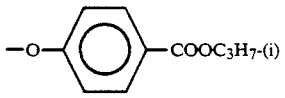
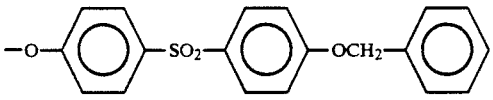
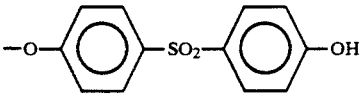
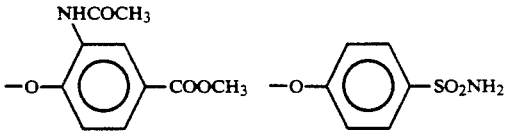
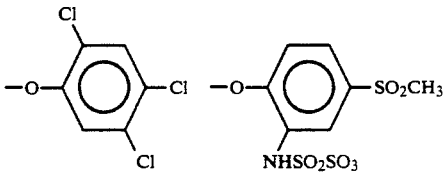
-continued
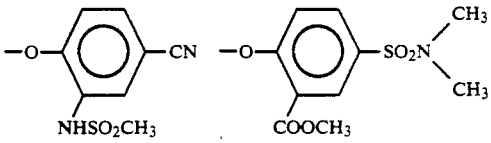
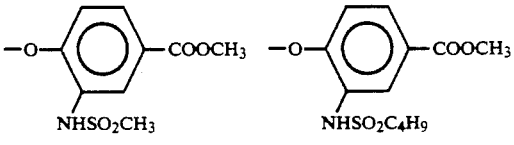
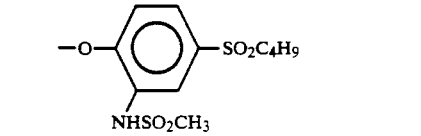
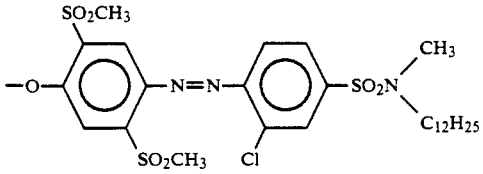
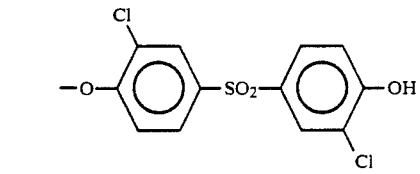
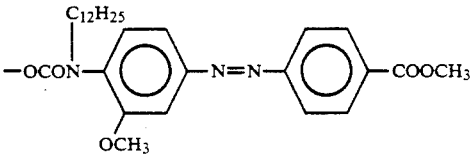
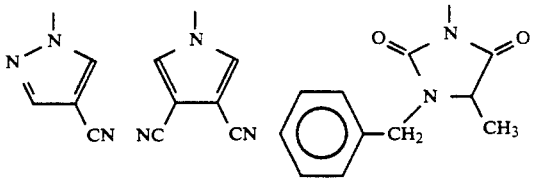
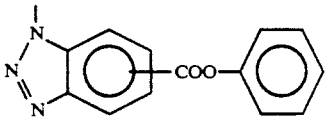
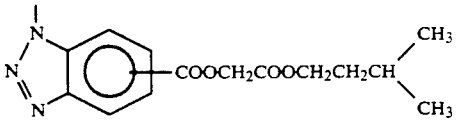

-continued
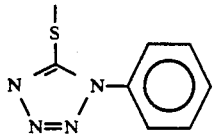
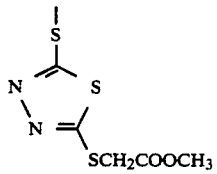
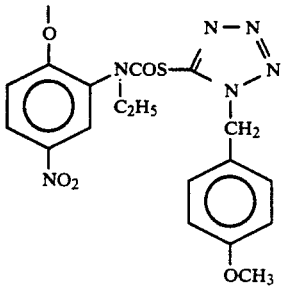
-continued
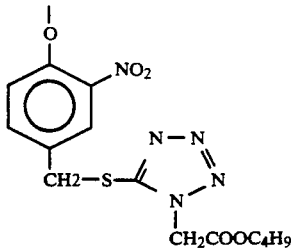
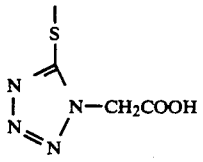
and
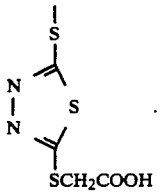
* * * * *